US009426600B2

(12) United States Patent
Bahne et al.

(10) Patent No.: US 9,426,600 B2
(45) Date of Patent: Aug. 23, 2016

(54) AUDIO PRECOMPENSATION CONTROLLER DESIGN WITH PAIRWISE LOUDSPEAKER CHANNEL SIMILARITY

(71) Applicant: DIRAC RESEARCH AB, Uppsala (SE)

(72) Inventors: Adrian Bahne, Uppsala (SE); Lars-Johan Brannmark, Uppsala (SE); Anders Ahlen, Knivsta (SE)

(73) Assignee: DIRAC RESEARCH AB, Uppsala (SE)

( * ) Notice: Subject to any disclaimer, the term of this patent is extended or adjusted under 35 U.S.C. 154(b) by 0 days.

(21) Appl. No.: 14/402,900

(22) PCT Filed: Jun. 20, 2013

(86) PCT No.: PCT/SE2013/050748

§ 371 (c)(1),
(2) Date: Nov. 21, 2014

(87) PCT Pub. No.: WO2014/007724

PCT Pub. Date: Jan. 9, 2014

(65) Prior Publication Data

US 2015/0131826 A1 May 14, 2015

Related U.S. Application Data

(60) Provisional application No. 61/668,516, filed on Jul. 6, 2012.

(51) Int. Cl.

| | |
|---|---|
| ***H04S 7/00*** | (2006.01) |
| ***H04R 3/04*** | (2006.01) |
| *H04R 5/04* | (2006.01) |
| *H04R 3/12* | (2006.01) |

(52) U.S. Cl.

CPC *H04S 7/307* (2013.01); *H04R 3/04* (2013.01); *H04S 7/301* (2013.01); *H04R 3/12* (2013.01); *H04R 5/04* (2013.01)

(58) Field of Classification Search
None
See application file for complete search history.

(56) References Cited

U.S. PATENT DOCUMENTS

| | | | | |
|---|---|---|---|---|
| 5,949,894 | A | 9/1999 | Nelson et al. | |
| 2007/0019815 | A1* | 1/2007 | Asada | H04R 29/00 381/58 |
| 2015/0373476 | A1* | 12/2015 | Christoph | H04S 7/302 381/303 |

FOREIGN PATENT DOCUMENTS

| | | |
|---|---|---|
| EP | 1 696 702 | 8/2006 |

OTHER PUBLICATIONS

Extended European Search Report, dated Dec. 8, 2015; Application No. 13813994.4.

*Primary Examiner* — Paul Huber
(74) *Attorney, Agent, or Firm* — Young & Thompson

(57) ABSTRACT

A method for determining an audio precompensation controller for an associated sound generating system comprising a total of N≥2 loudspeakers, each having a loudspeaker input. The audio precompensation controller has a number L≥2 inputs for L input signal(s) and N outputs for N controller output signals, one to each loudspeaker. It is relevant to: estimate (S1), for each one of at least a subset of the N loudspeaker inputs, an impulse response at each measurement position; specify (S2), for each one of the L input signal(s), a selected one of the N loudspeakers as a primary loudspeaker and optionally a selected subset S including at least one of the N loudspeakers as support loudspeaker(s); select (S2) at least one loudspeaker pair, that is required to be symmetrical with respect to the listing position; and specify (S3), for each primary loudspeaker, a target impulse response at each measurement position.

22 Claims, 13 Drawing Sheets

AUDIO PRECOMPENSATION CONTROLLER DESIGN WITH PAIRWISE LOUDSPEAKER CHANNEL SIMILARITY

TECHNICAL FIELD OF THE INVENTION

The present invention generally concerns digital audio precompensation and more particularly a method and a system as well as a computer program product for the design of a digital audio precompensation controller that generates several signals to a sound generating system. It also concerns an improved audio precompensation controller as well as an audio system and a digital audio signal generated by such an audio precompensation controller.

BACKGROUND OF THE INVENTION

Similarity between the room transfer functions (RTFs) of symmetric loudspeaker pairs in a multichannel audio system[1], e.g., left and right in a stereo system, or front left and front right, and surround left and surround right in a 5.1 surround system, is a basic requirement for correct sound reproduction [8, 11]. All equalization methods, which aim at attaining the same target response for two loudspeaker channels individually, would, ideally, obtain similarity between the channels as a byproduct. However, unless the listening environment is a perfectly symmetric room with respect to the considered loudspeaker pair, and the loudspeakers are identical, this is not a realistic outcome. Hence, if similarity between RTF-pairs is crucial, as is the case in, e.g., a stereo setup, then it is desirable that a RTF equalization design also takes similarity into account.

[1]In other words, symmetric loudspeaker pairs with respect to sound reproduction standards. The actual loudspeaker placement may differ from standard recommendations and is not required to be symmetric.

In general, multichannel sound reproduction always has the problem of identity: As discussed in [20, 8], for the example of stereophonic sound reproduction, exact reproduction of recorded sound in other than the genuine recording environment, by means of two loudspeakers, must be considered an impossible task. Multichannel systems with more than two channels may overcome this problem to some extent, nevertheless they still suffer from this limitation. On the other hand we know that, irrespective of the recording techniques used to create the source material, the end product of recording, mixing and mastering multichannel audio material always is a number of audio signals, e.g. two channels for stereo or six channels for 5.1 surround. The resulting perceived sound image is defined by the amplitude and phase content of those signals and their relation to each other [9, 21, 7, 11]. The mixing of the sound image is an artistic part of the production process, and by means of, e.g., microphone techniques, signal mixing and additional sound effects, the resulting sound image is created by the recording engineer [2]. Having said this, we believe that an optimal equalizer design should not strive to attain the original sound image, since this may have been altered significantly by the recording engineer anyway. Instead, as the listening experience of any equalized sound system equals, at best, the listening experience of the recording professional in the recording studio, it should strive to attain the sound image as intended by the recording engineer.

Therefore, the listening conditions in the recording studio and the psychoacoustic principles of multichannel sound reproduction are of importance. Recording studios usually constitute controlled listening environments, consisting of control rooms with symmetric loudspeaker setups with respect to the room and listening position [10, 3, 11]. In these controlled environments we can assume the RTFs of loudspeaker pairs to be fairly similar. This in accordance with [8, 21], where it is pointed out that reproducing the intended stereo image of stereo recordings requires equal intensity and equal acoustic transfer functions from the input to the two loudspeakers to the listening region. Unlike the recording professionals, the typical audience does not listen in such controlled environments. Thus, stereo or surround reproduction in, e.g., consumer homes can be assumed to severely suffer from flawed sound image reproduction.

SUMMARY OF THE INVENTION

It is a general objective to provide an extended precompensation strategy for improving the reproduction of stereo, or multichannel audio material over two or more loudspeakers.

It is a specific objective to provide a method for determining an audio precompensation controller for an associated sound generating system.

It is another specific objective to provide a system for determining an audio precompensation controller for an associated sound generating system.

It is yet another specific objective to provide a computer program product for determining an audio precompensation controller for an associated sound generating system.

It is also a specific object to provide an improved audio precompensation controller, as well as an audio system comprising such an audio precompensation controller and a digital audio signal generated by such an audio precompensation controller.

The inventors have recognized that a key to solve the above issue of reproducing an intended sound image of, e.g., stereo or surround recordings, is to not only equalize the individual loudspeaker channels according to a desired target, but also to explicitly require a symmetry, or similarity, between the RTFs of one or more loudspeaker pairs.

According to a first aspect, a basic idea is to determine an audio precompensation controller for an associated sound generating system comprising a total of $N \geq 2$ loudspeakers, each of which is having a loudspeaker input. The sound generating system includes at least one pair of loudspeaker channels. The audio precompensation controller has a number $L \geq 2$ inputs for L input signals and N outputs for N controller output signals, one to each loudspeaker of the sound generating system, and the audio precompensation controller generally has a number of adjustable filter parameters. It is relevant to estimate, for each one of at least a subset of the N loudspeaker inputs, an impulse response at each of a plurality $M \geq 2$ of measurement positions, distributed in a region of interest in a listening environment, based on sound measurements at the M measurement positions.

It is also relevant to specify, for each one of the L input signals, a selected one of the N loudspeakers as a primary loudspeaker and optionally also a selected subset S including one or more of the N loudspeakers as support loudspeaker(s), where the primary loudspeaker is not part of this subset. Here a subset, or all of, the N loudspeakers may be virtual sources. By example, some physical loudspeaker setup may reproduce two virtual loudspeakers, or virtual sources, that are considered as a stereo pair and are thus intended to be similar. Further the method involves specifying, for each of the L input signals, a loudspeaker pair, if feasible, that is required to be symmetric, or similar, with respect to the listener position. For example, for a stereo sound system, the left and right loudspeaker are required to be symmetric with respect to the listener position, regardless of their actual, and potentially deviating, placement in the room. The method involves specifying, for each primary loudspeaker, a target impulse response at each of the M measurement positions.

The idea is then to determine, for each one of the L input signals, based on the selected primary loudspeaker, the selected loudspeaker pair(s), and the optionally selected support loudspeaker(s), filter parameters of the audio precompensation controller so that a criterion function, which takes loudspeaker channel symmetry, or loudspeaker channel similarity, of at least one pair of said loudspeakers, into account, is optimized under the constraint of stability of the dynamics of the audio precompensation controller. Preferably, the criterion function includes a weighted summation of powers of differences between the compensated estimated impulse responses and the target impulse responses over the M, or a subset of M, measurement positions, and a weighted and permuted summation of powers of differences between at least one pair of equalized symmetrical room transfer functions (RTFs).

With a RTF we mean the acoustic channel from the source to a point in space. This includes all electronics from the source to the loudspeaker, the loudspeaker, the acoustic multi-path propagation channel e.g., the room, and the microphone and its associated electronics. In an interchangeable manner we sometimes use the expression loudspeaker channel pair, or loudspeaker pair instead of pairs of RTFs. We also use the expression 'symmetric' and 'similar' interchangeably to describe the situation of having a pair of loudspeakers, or RTFs, where the loudspeakers, or RTFs, are required to be symmetric, or similar, with respect to the listener position. Note that we consider symmetry as recommended in sound reproduction standards, like, e.g., stereophonic sound reproduction [8]. The actual loudspeaker placement may differ from standard recommendations and is not required to be symmetric. To clarify, the use of the expression 'similarity between pairs' denotes similarity between the loudspeakers in each pair.

The proposed technology embodies a number of special design choices. For example, in the weighted summation of powers of differences between the compensated estimated impulse response and the target impulse response, some or all of the weights can be selected to zero. If all weights are zero, then the weighted summation of powers of differences between the compensated estimated impulse response and the target impulse response is disregarded in the criterion function. Further, the weights can be chosen such that only one of the M measurement positions is considered in the criterion function, which corresponds to the situation of having performed only one measurement.

Another example is when only one mono signal is available as source signal. Then the L input signals to the controller can be fed with this mono signal. In other words, the mono signal is then split into L identical signals, which are fed into the L controller inputs. If this split operation is regarded as a part of the controller, then the controller can be viewed as having one mono input.

In a second aspect, there is provided a method that is capable of handling one or more of these special design choices. A basic idea is to determine an audio precompensation controller for an associated sound generating system comprising a total of N≥2 loudspeakers, each having a loudspeaker input. The audio precompensation controller has a number L inputs for L input signal(s) and N outputs for N controller output signals, one to each loudspeaker of said sound generating system. In general, the audio precompensation controller has a number of adjustable filter parameters. It is relevant to estimate, for each one of at least a subset of the N loudspeaker inputs, an impulse response at measurement position(s) in a listening environment, based on sound measurements at the measurement position(s). It is also important to specify at least one loudspeaker pair, where said loudspeaker pair is required to be symmetric, or similar, with respect to the listening position. The idea is then to determine, for each one of said L input signals, based on the selected loudspeaker pair, filter parameters of the audio precompensation controller so that a criterion function is optimized under the constraint of stability of the dynamics of the audio precompensation controller. The criterion function includes a weighted and permuted summation of powers of differences between at least one pair of equalized symmetrical room transfer functions (RTFs). In other words, the equalized symmetrical RTFs correspond to compensated estimated impulse responses.

The different aspects of the invention include a method, system and computer program product for determining an audio precompensation controller, a so determined precompensation controller, an audio system incorporating such an audio precompensation controller as well as a digital audio signal generated by such an audio precompensation controller.

The present invention offers at least some of the following advantages:

- Improved design scheme for an audio precompensation controller.
- Improved reproduction of stereo or multi-channel audio material over two or more loudspeakers.
- Higher robustness in the filter design process due to an extra term in the criterion function.
- Improved similarity between pairs of selected loudspeaker channels and thus improved sound quality by improved sound image reproduction.
- Higher flexibility where the performance improvements are not constrained to low frequencies.
- Control over issues such as causality and pre-ringing artifacts.

Other advantages and features offered by the present invention will be appreciated upon reading of the following description of the embodiments of the invention.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the drawings, the same reference numbers are used for similar or corresponding elements.

The proposed technology is based on the recognition that mathematical models of dynamic systems, and model-based optimization of digital precompensation filters, provide powerful tools for designing filters that improve the performance of various types of audio equipment by modifying the input signals to the equipment. It is furthermore noted that appropriate models can be obtained by measurements at a plurality of measurement positions distributed in a region of interest in a listening environment.

Figure 3:
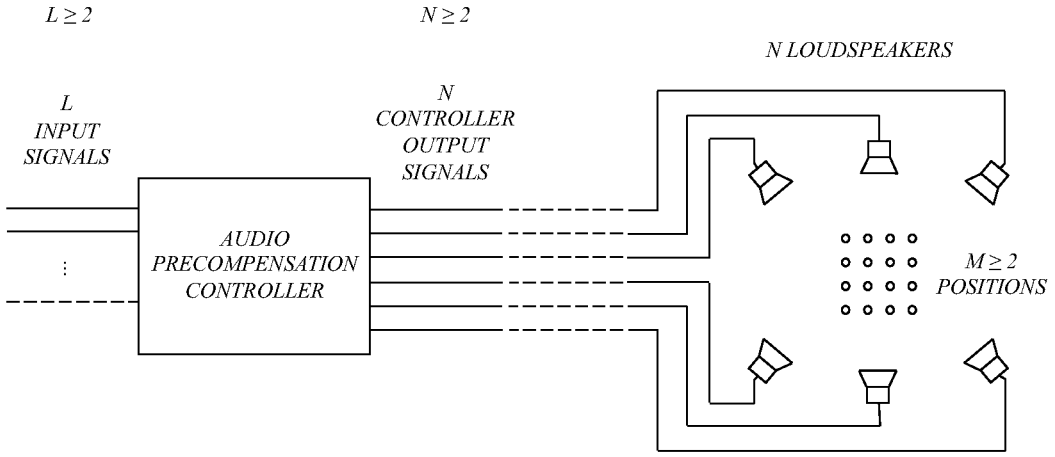
FIG. 3 is a schematic diagram illustrating an example of an audio system including a sound generating system and an audio precompensation controller.

As mentioned, according to a first aspect, a basic idea is to determine an audio precompensation controller for an associated sound generating system. As illustrated in the example of FIG. 3, the sound generating system comprises a total of N≥2 loudspeakers, each having a loudspeaker input. The sound generating system includes at least one pair of symmetrical loudspeaker channels. The audio precompensation controller has a number L≥2 inputs for L input signals and N outputs for N controller output signals, one to each loudspeaker of the sound generating system. It should be understood that the controller output signals are directed to the loudspeakers, i.e. in the input path of the loudspeakers. The controller output signals may be transferred to the loudspeaker inputs via optional circuitry (indicated by the dashed lines) such as digital-to-analog converters, amplifiers and additional filters. The optional circuitry may al so include a wireless link.

In general, the audio precompensation controller has a number of adjustable filter parameters, to be determined in the filter design scheme. The audio precompensation controller, when designed, should thus generate N controller output signals to the sound generating system with the aim of modifying the dynamic response of the compensated system, as measured in a plurality M≥2 of measurement positions, distributed in a region of interest in a listening environment, see FIG. 3.

Figure 5:
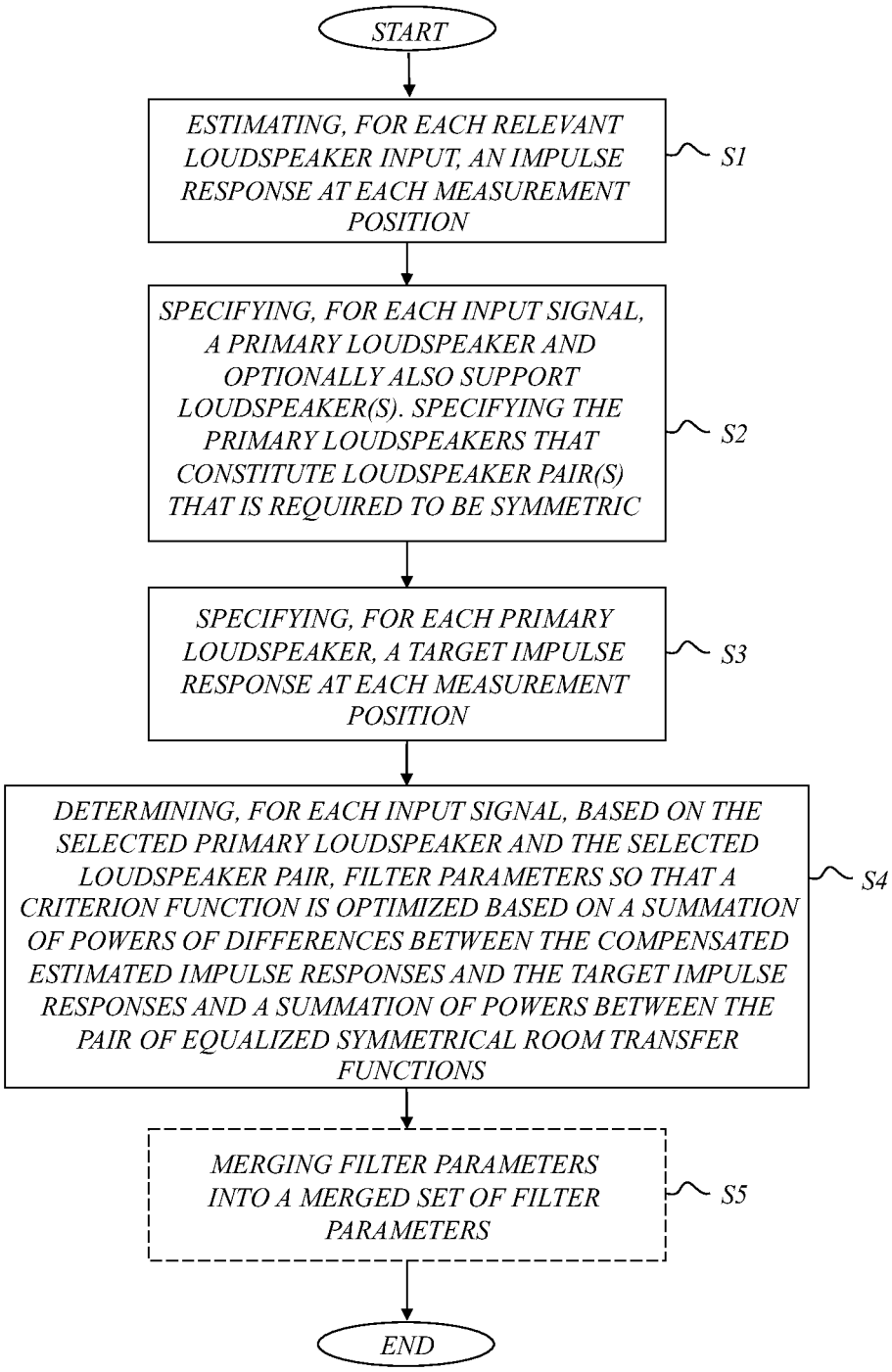
FIG. 5 is a schematic flow diagram illustrating a method for determining an audio precompensation controller according to an exemplary embodiment.

FIG. 5 is a schematic flow diagram illustrating a method for determining an audio precompensation controller according to an exemplary embodiment. Step S1 involves estimating, for each one of at least a subset of the N loudspeaker inputs, an impulse response at each of a plurality M≥2 of measurement positions, distributed in a region of interest in a listening environment, based on sound measurements at the M measurement positions. Step S2 involves specifying, for each one of the L input signals, a selected one of the N loudspeakers as a primary loudspeaker and possibly also a selected subset S including one or more of the N loudspeakers as support loudspeaker(s), where the primary loudspeaker is not part of this subset. Further it is relevant to specify, for each of the L input signals, a loudspeaker pair, if feasible, that is required to be symmetric, or similar, with respect to the listener position. In other words, it is required to specify at least one loudspeaker pair where the two loudspeakers are required to be symmetric with respect to the sound reproduction standard, regardless their actual, and potentially deviating, placement in the room. Step S3 involves specifying, for each primary loudspeaker, a target impulse response at each of the M measurement positions. Step S4 involves determining, for each one of the L input signals, based on the selected primary loudspeaker, the selected loudspeaker pair(s), and the optionally selected support loudspeaker(s), filter parameters of the audio precompensation controller so that a criterion function, taking pairwise symmetry, or similarity, of the channels of the symmetric loudspeaker pair(s) into account, is optimized under the constraint of stability of the dynamics of the audio precompensation controller. Preferably, the criterion function includes a weighted summation of powers of differences between the compensated estimated impulse responses and the target impulse responses over the M measurement positions and a weighted and permuted summation of powers of differences between at least one pair of equalized symmetrical RTFs. Note that the weights can be chosen such that a subset, e.g., only one, of the M measurement positions is considered in the criterion function.

Expressed differently, the audio precompensation controller, taking pairwise channel similarity into account, is configured for controlling the acoustic response of P primary loudspeakers, where $2 \leq P \leq L$ and $2 \leq P \leq N$, by the combined use of the P primary loudspeakers and, for each primary loudspeaker, optionally also an additional number of support loudspeakers $0 \leq S \leq N-1$ of the N loudspeakers. However, we clarify that in some cases, when two or more loudspeaker pairs are specified, it can be meaningful to specify that some of the loudspeaker pairs share a primary loudspeaker, which thus is part of one or more loudspeaker pairs simultaneously.

The method may also include the optional step S5 of merging all of the filter parameters, determined for the L input signals, into a merged set of filter parameters for the audio precompensation controller, especially if there are three or more input signals, i.e. $L \geq 3$. The audio precompensation controller, with the merged set of filter parameters, is configured for operating on the L input signals to generate the N controller output signals to the loudspeakers to attain the target impulse responses.

In a particular example the target impulse response has an acoustic propagation delay, where the acoustic propagation delay is determined based on the distance from the primary loudspeaker to the respective measurement position.

By way of example, it may be desirable for the audio precompensation controller to have the ability of producing output zero to some of the N loudspeakers for some setting of its adjustable filter parameters.

In a particular example, in the weighted summation of powers of differences between the compensated estimated impulse response and the target impulse response, at least some of the weights are non-zero. Also, in the weighted and permuted summation of powers of differences between a pair of equalized RTFs, at least some of the weights are non-zero. Further, the weights can be chosen such that at least one measurement position is considered in the criterion function.

Preferably, the target impulse responses are non-zero and include adjustable parameters that can be modified within prescribed limits. For example, the adjustable parameters of the target impulse responses, as well as the adjustable parameters of the audio precompensation controller, may be adjusted jointly, with the aim of optimizing the criterion function.

In a particular example embodiment, the step of determining filter parameters of the audio precompensation controller is based on a Linear Quadratic Gaussian (LQG) optimization of the parameters of a stable, linear and causal multivariable feedforward controller based on a given target dynamical system, a similarity requirement, or condition, and a dynamical model of the sound generating system. As mentioned, the controller output signals may be transferred to the loudspeaker inputs via optional circuitry. For example, each one of the N controller output signals of the audio precompensation controller may be fed to a respective loudspeaker via an all-pass filter including a phase compensation component and a delay component, yielding N filtered controller output signals.

Optionally, the criterion function includes penalty terms, with the penalty terms being such that the audio precompensation controller, obtained by optimizing the criterion function, produces signal levels of constrained magnitude on a selected subset of the precompensation controller outputs, yielding constrained signal levels on selected loudspeaker inputs to the N loudspeakers for specified frequency bands.

The penalty terms may be chosen such that similarity between the channels of the selected loudspeaker pair(s) is taken into account in all or a subset of the M measurement positions and such that the importance of different measurement positions, in which similarity is taken into account, may be weighted with respect to both frequency and space.

The penalty terms may be differently chosen a number of times, and the step of determining filter parameters of the audio precompensation controller is repeated for each choice of the penalty terms, resulting in a number of instances of the audio precompensation controller, each of which produces signal levels with individually constrained magnitudes to the S support loudspeakers for specified frequency bands.

In a further optional embodiment, the criterion function contains a representation of possible errors in the estimated impulse responses. This error representation is designed as a set of models that describe the assumed range of errors. In this particular embodiment, the criterion function also contains an aggregation operation which can be a sum, a weighted sum, or a statistical expectation over said set of models.

In a particular example, the step of determining filter parameters of the audio precompensation controller is also based on adjusting filter parameters of the audio precompensation controller to reach a target magnitude frequency response, taking into account similarity, of the sound generating system including the audio precompensation controller, in at least a subset of the M measurement positions.

By way of example, the step of adjusting filter parameters of the audio precompensation controller is based on the evaluation of magnitude frequency responses in at least a subset of the M measurement positions and thereafter determining a minimum phase model of the sound generating system including the audio precompensation controller.

Preferably, the step of estimating, for each one of at least a subset of the N loudspeaker inputs, an impulse response at each of a plurality M of measurement positions is based on a model describing the dynamical response of the sound generating system at the M measurement positions.

As understood by a skilled person, the audio precompensation controller may be created by implementing the filter parameters in an audio filter structure. The audio filter structure is then typically embodied together with the sound generating system to enable generation of the target impulse response at the M measurement positions in the listening environment.

The proposed technology may be used in many audio applications. For example, the sound generating system may be a car audio system or mobile studio audio system and the listening environment may be part of a car or a mobile studio. Other examples of sound generating system include a cinema theater audio system, concert hall audio system, home audio system, or a professional audio system, where the corresponding listening environment is part of a cinema theater, a concert hall, a home, a studio, an auditorium, or any other premises.

The proposed technology embodies a number of special design choices. For example, in the weighted summation of powers of differences between the compensated estimated impulse response and the target impulse response, some or all of the weights can be selected to zero. If all weights are zero, then the weighted summation of powers of differences between the compensated estimated impulse response and the target impulse response is disregarded in the criterion function. Further, the weights can be chosen such that only one of the M measurement positions is considered in the criterion function, which corresponds to the situation of having performed only one measurement. In the weighted and permuted summation of powers of differences between a pair of equalized RTFs, at least some of the weights are non-zero.

Another example is when only one mono signal is available as source signal. Then the L input signals to the controller can be fed with this mono signal. In other words, the mono signal is then split into L identical signals, which are fed into the L controller inputs. If this split operation is regarded as a part of the controller, then the controller can be viewed as having one mono input.

As mentioned, according to a second aspect, there is provided a method that is capable of handling one or more of these special design choices. A basic idea is to determine an audio precompensation controller for an associated sound generating system comprising a total of N≥2 loudspeakers, each having a loudspeaker input, has a number L inputs for L input signal(s) and N outputs for N controller output signals, one to each loudspeaker of said sound generating system. In general, the audio precompensation controller has a number of adjustable filter parameters, to be determined in the filter design scheme.

Figure 6:
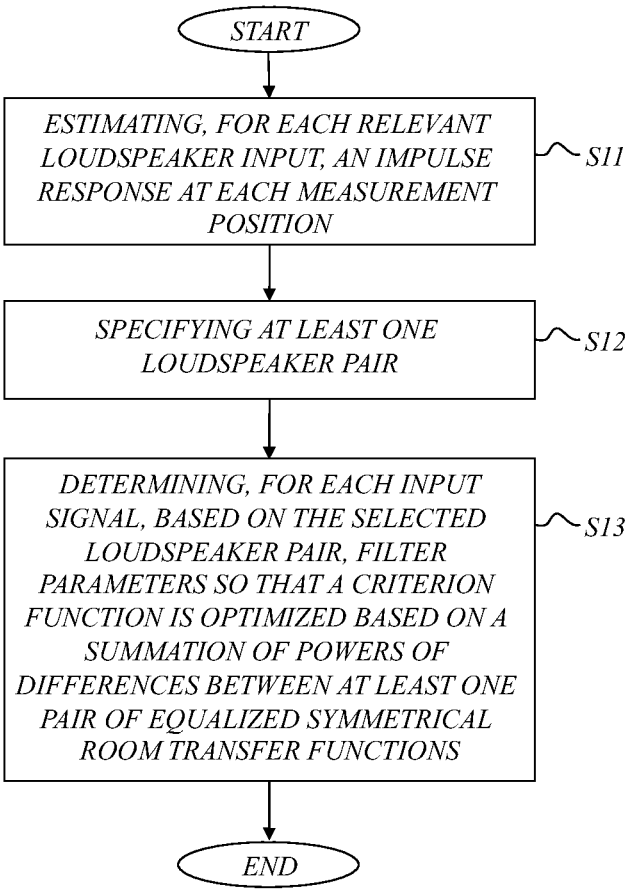
FIG. 6 is a schematic flow diagram illustrating a method for determining an audio precompensation controller according to an embodiment of special cases.

FIG. 6 is a schematic flow diagram illustrating a method for determining an audio controller according to an embodiment of special cases. Step S11 involves estimating, for each one of at least a subset of the N loudspeaker inputs, an impulse response at measurement position(s) in a listening environment, based on sound measurements at the measurement position(s). Step S12 involves specifying at least one loudspeaker pair, where said loudspeaker pair is required to be symmetric, or similar, with respect to the listening position. Step S13 involves determining, for each one of said L input signals, based on the selected loudspeaker pair, filter parameters of the audio precompensation controller so that a criterion function is optimized under the constraint of stability of the dynamics of the audio precompensation controller. The criterion function includes a weighted and permuted summation of powers of differences between at least one pair of equalized symmetrical room transfer functions (RTFs). In other words, the equalized symmetrical RTFs correspond to compensated estimated impulse responses.

The proposed technology will now be described in more detail with reference to various non-limiting, exemplary embodiments.

Sound Field Control by Linear Dynamic Precompensation

The acoustic signal path from loudspeaker input to microphone will be modeled as a linear time-invariant system (LTI), which is fully described by its RTF.

Figure 1:
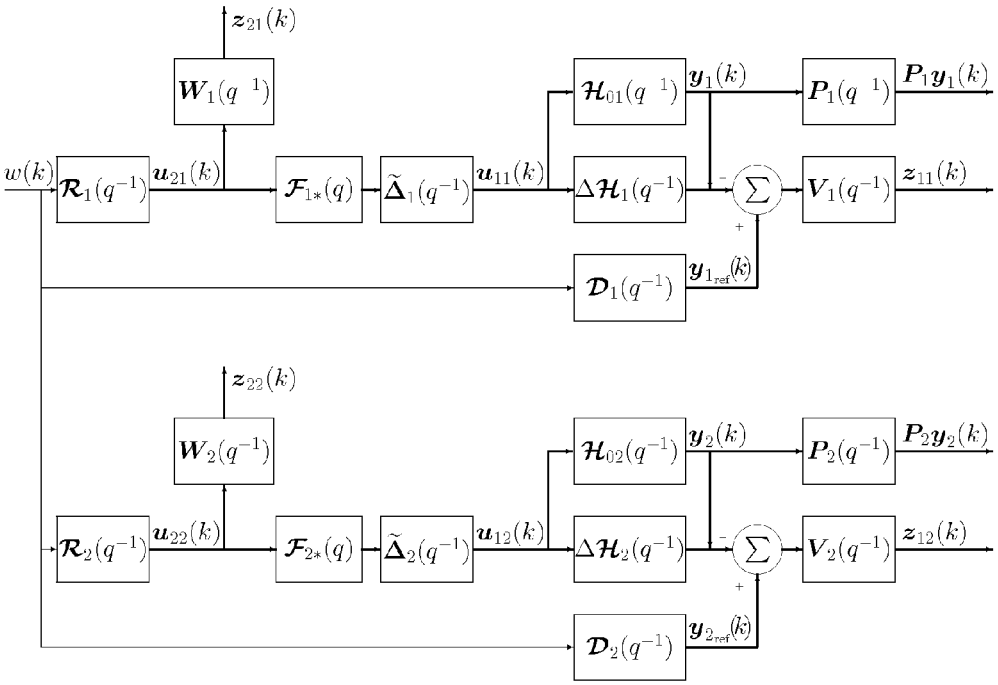
FIG. 1 describes a channel similarity MIMO controller design for two primary loudspeakers that constitute a loudspeaker channel pair. Let $n \in \{1, 2\}$ describe the two primary loudspeakers and let the total number of loudspeakers N be the union of $N_1$ and $N_2$, i.e. $N=N_1 \cup N_2$. The multichannel compensator is given by $\mathcal{R}_n$, where the signal w(k) is the input signal. The compensator produces a multichannel control signal $u_{2n}(k)$ with $N_n$ elements that acts as input to the stable linear dynamic multiple-input multiple-output (MIMO) model $\mathcal{H}_n(q^{-1})=(\mathcal{H}_{0n}(q^{-1})+\Delta\mathcal{H}_n(q^{-1}))\tilde{\Delta}_n(q^{-1})\mathcal{F}_{n*}(q)$ of the acoustic system. The model $\mathcal{H}_n$ has $N_n$, inputs and M outputs, where the $N_n$ inputs represent the inputs to $N_n$ loudspeakers and the M outputs represent M measurement positions. The nominal acoustic signals at the M measurement positions are represented by a column vector $y_n(k)$. The desired dynamic system properties are specified by a stable SIMO model $\mathcal{D}_n$, which has one input and M outputs. When the signal w(k) is used as input to $\mathcal{D}_n$, the resulting output is a desired signal vector $y_{n_{ref}}(k)$ with M elements.

Consider a multichannel audio system comprising N loudspeakers, N≥2 and $1 \le N_n \le N$, around a bounded three dimensional listening area $\Omega \in \mathbb{R}^3$ in a room. Here, $N_n$, $n \in \{1, 2\}$, represents the total number of loudspeakers used for each primary loudspeaker, including itself, in each pair of loudspeakers required to be similar, see FIG. 1. As an example consider a 5.1 surround loudspeaker setup. The total number of loudspeakers (called 1, 2, 3, 4, 5, and 6) is then N=6. Suppose that we require the front left (FL) and front right (FR) loudspeakers to be similar. Further suppose that, for (FL), $N_1$=3 loudspeakers, here (1, 2, 3), are used to obtain similarity with (FR) and attain the target specified for (FL). Likewise suppose that, for (FR), $N_2$=5 loudspeakers, here (2, 3, 4, 5, and 6), are used to make (FR) similar to (FL) and attain the specified target. Hence, the total number of loudspeakers N=6 used for the setup is given by the union of $N_1$ and $N_2$, i.e., $N=N_1 \cup N_2$. The acoustic output of the system is measured in M control points, or measurement positions, uniformly distributed within Ω. Here, although the two primary loudspeakers may have a different number of support loudspeakers $N_n-1$, the listening volume Ω and the control points M are identical for both sets of $N_n$ loudspeakers. Let the $N_n$ input signals of the above sound system be represented by a signal vector $u_{1n}(k)=[u_{11n}(k) \ldots u_{1N_n n}(k)]^T$ of dimension $N_n \times 1$ and let the M output signals be represented by a signal vector $y_n(k)=[y_{1n}(k) \ldots y_{Mn}(k)]^T$ of dimension M×1. Then the relation between $u_{1n}(k)$ and $y_n(k)$ is given by $$y_n(k)=\mathcal{H}_n(q^{-1})u_{1n}(k) \tag{1}$$

where $\mathcal{H}_n(q^{-1})$ is a rational matrix of dimension $M \times N_n$, with elements that are scalar stable rational functions $\mathcal{H}_{ijn}(q^{-1})$; i=1, . . . , M; j=1, . . . , $N_n$.

Furthermore, considering a feasible amount of M control points resulting in models obtained from spatially sparse measurement data, we shall employ the stochastic uncertainty model presented in [4, 17, 19]. Hence, the linear system model is decomposed into a sum of two parts, one deterministic nominal part and one stochastic uncertainty part, where the uncertainty part is partly parameterized by random variables. The nominal part will here represent those components of the transfer functions that are known to be varying only slowly with respect to space (and which therefore are well captured by spatially sparse RTF measurements), whereas the uncertainty part represents components that are not fully captured by such measurements. Typically, these spatially complex components consist of late room reflections and reverberation at high frequencies. Accordingly, $\mathcal{H}_n(q^{-1})$ in (1) is decomposed as $$\mathcal{H}_n(q^{-1})=\mathcal{H}_{0n}(q^{-1})+\Delta\mathcal{H}_n(q^{-1}), \tag{2}$$

where $\mathcal{H}_{0n}(q^{-1})$ is the nominal model and $\Delta\mathcal{H}_n(q^{-1})$ constitutes the uncertainty model. Writing out the matrix fractions for $\mathcal{H}_n(q^{-1})$ and $\Delta\mathcal{H}_n(q^{-1})$, the decomposition (2) of $\mathcal{H}_n(q^{-1})$ expands into $$\begin{aligned}\mathcal{H}_n &= B_{0n}A_{0n}^{-1} + \Delta B_n B_{1n} A_{1n}^{-1} \\ &= (B_{0n}A_{1n} + \Delta B_n B_{1n} A_{0n})(A_{0n}A_{1n})^{-1} \\ &= (\hat{B}_{0n} + \Delta B_n \hat{B}_{1n})(A_{0n}A_{1n})^{-1} \triangleq B_n A_n^{-1},\end{aligned} \tag{3}$$

where $\hat{B}_{0n}=B_{0n}A_{1n}$, $\hat{B}_{1n}=B_{1n}A_{0n}$, and $A_n=A_{0n}A_{1n}$. The matrices $B_{0n}$, $B_{0n}$, $\Delta B_n$ and $B_n$ are of dimension $M \times N_n$, whereas $\hat{B}_{1n}$, $B_{1n}$, $A_{0n}$, $A_{1n}$ and $A_n$ are of dimension $N_n \times N_n$. The elements of $\Delta B_n$ are polynomials with zero mean random variables as coefficients and $B_{1n}A_{1n}^{-1}$ is a filter for shaping the spectral distribution of the stochastic uncertainty model.

The target RTF, of dimension M×1, is parameterized as $$\mathcal{D}_n(q^{-1}) = \frac{\mathcal{D}_n(q^{-1})}{E_n(q^{-1})} = q^{-d_0}\frac{\tilde{\mathcal{D}}_n(q^{-1})}{E_n(q^{-1})}. \tag{4}$$

In $\tilde{D}_n(q^{-1})$ above, at least one of the polynomial elements is assumed to have a non-zero leading coefficient; the second equality in (4) is included to emphasize that $\mathcal{D}_n(q^{-1})$ contains an initial modeling delay of $d_0$ samples.

Acoustic Modeling

The room-acoustic impulse responses of each of N loudspeakers are estimated from measurements at M positions which are distributed over the spatial region of intended listener positions. It is recommended that the number of measurement positions M is larger than the number of loudspeakers N. The dynamic acoustic responses can then be estimated by sending out test signals from the loudspeakers, one loudspeaker at a time, and recording the resulting acoustic signals at all M measurement positions. Test signals such as white or colored noise or swept sinusoids may be used for this purpose. Models of the linear dynamic responses from one loudspeaker to M outputs can then be estimated in the form of FIR or IIR filters with one input and M outputs. Various system identification techniques such as the least squares method or Fourier-transform based techniques can be used for this purpose. The measurement procedure is repeated for all loudspeakers, finally resulting in a model $\mathcal{H}_n$ that is represented by a $M \times N_n$ matrix of dynamic models. The multiple input-multiple output (MIMO) model may alternatively be represented by a state-space description.

An example of a mathematically convenient, although very general, MIMO model for representing a sound reproduction system is by means of a right Matrix Fraction Description (MFD) [12] with diagonal denominator, $$\mathcal{H}_n(q^{-1}) = B_n(q^{-1})A_n^{-1}(q^{-1}) \tag{5}$$

$$= \begin{bmatrix} B_{11n}(q^{-1}) & \dots & \dots & B_{1N_n n}(q^{-1}) \\ \vdots & & & \vdots \\ \vdots & & & \vdots \\ B_{M1n}(q^{-1}) & \dots & \dots & B_{MN_n n}(q^{-1}) \end{bmatrix} \begin{bmatrix} A_{1n}(q^{-1}) & 0 & \dots & 0 \\ 0 & \ddots & & \vdots \\ \vdots & & \ddots & 0 \\ 0 & \dots & 0 & A_{N_n n}(q^{-1}) \end{bmatrix}^{-1},$$

which is the type of MFD that will be utilized in the following. An even more general model can be obtained if the matrix $A_n(q^{-1})$ is allowed to be a full polynomial matrix, and there is nothing in principle that prohibits the use of such a structure. However, we shall adhere to the structure (5) in the following, as it allows a more transparent mathematical derivation of the optimal controller. Note that $\mathcal{H}_n$, as defined in (5) may include a parametrization that describes model errors and uncertainties, as given for example by (2).

Selection of Primary and Support Loudspeakers

For a given sound reproduction system, a precompensation controller is to be designed with the aim of improving the acoustic reproduction of $L \geq 2$ source signals by the use of at least two physical loudspeakers. To improve the acoustic reproduction here means that the impulse response of a physical loudspeaker, as measured in a number of points, is altered by the compensator in such a way that its deviation from a specified ideal target response is minimized and that it's equalized impulse response is as similar as possible to the equalized impulse response of the corresponding other symmetrical channel of the selected loudspeaker pair.

In order to obtain a compensator that is more general than existing common compensators, the present design is performed under as few restrictions as possible regarding filter structures and how the loudspeakers are used. The only restrictions posed on the compensator is linearity, causality and stability. The restriction of common compensators, i.e., the restriction that each of the L source signals can be processed by only one single filter and distributed to only one loudspeaker input, is here relaxed. The compensator associated with each one of the L source signals is thus allowed to consist of more than one filter, yielding at least one, but optionally several, processed versions of the source signal, to be distributed to at least one, but optionally several, loudspeakers.

We assume here that the L source signals have been produced with some particular intended physical loudspeaker layout in mind. This layout is assumed to consist of at most L loudspeakers, and each of the L source signals is intended to be fed into at most one loudspeaker input. For example, an established audio source format such as two-channel stereo (L=2) is intended to be played back through a pair of loudspeakers positioned symmetrically in front of the listener, where the first source channel is fed to the left loudspeaker and the second source channel is fed to the right loudspeaker. In case a mono source signal is to be reproduced, the input signal can be split up in L identical inputs, resulting in for example (L=2) input signals for reproduction of a mono source signal over a stereo sound system. This split operation can be regarded as a part of the controller which then has only one controller input. Another source format is 5.1 surround which consists of totally six audio channels (L=6) that are intended to be played back in a one-to-one fashion (i.e., without any cross-mixing of channels) through five loudspeakers and a sub woofer, where both the two front channels and the two rear channels are played back through loudspeakers positioned symmetrically with respect to the listener. In the case that the source signals are a result of some upmixing algorithm (for example an algorithm that produces a six-channel 5.1 surround material out of a two-channel stereo recording), we shall associate L with the number of channels in the upmixed material (i.e., in the example of stereo-to-5.1 surround upmix, we shall use L=6 rather than L=2). In the down-mix case, i.e., when two or more of the L source signals are fed into the same loudspeaker input, we have the situation of an intended loudspeaker layout with less than L loudspeakers.

Another example is sound reproduction by means of loudspeaker cabinets containing several loudspeaker drivers, or transducers, where at least two of those drivers have individual inputs that can be fed with separate input signals. The use of this kind of loudspeaker cabinets offers many possible combinations of pairs of drivers or pairs of driver groups. The symmetry requirements discussed above are often violated in real life. Typical violations are unsymmetrical loudspeaker placement or unsymmetrical listening environments.

As mentioned above, we here want to construct a compensator that is allowed to use the loudspeakers of a system more freely. The aim of the compensator design is, however, to make the reproduction performance of the original intended loudspeaker layout as good as possible. To accomplish this we shall, for each one of the L source input signals distinguish between which loudspeaker belongs to that particular source signal in the original intended layout (this loudspeaker is henceforth called the primary loudspeakers of the concerned source signal), and which additional loudspeakers (henceforth called support loudspeakers) are optionally used by the compensator for improving the performance of the primary loudspeaker. Further, we shall specify which primary loudspeakers belong to symmetric loudspeaker pair(s). For example, for an audio system with four loudspeakers (called 1, 2, 3, and 4) that is to be used to playback a stereo recording (L=2 source signals), let loudspeaker 1 and 2 belong to the two source signals. Thus, loudspeaker 1 and 2 are the primary loudspeakers and a symmetric loudspeaker channel pair, whereas loudspeaker 3 and 4 are support loudspeakers.

Suppose that we have L source input signals and a system of totally N loudspeakers. Then, for each one of the L input signals there must be one associated primary loudspeaker. For each primary loudspeaker we then optionally choose a set of $S_n$ support loudspeakers among the remaining N−1 loudspeakers, where $0 \leq S_n \leq N-1$, to be used by the compensator for improving the performance of the primary loudspeakers. The total amount of loudspeakers used for each primary loudspeaker is thus $N_n=S_n+1$. The total number of loudspeakers N is given by the union of all loudspeakers used for all primary loudspeakers $N=N_1\cup \ldots \cup N_n$, n=1 . . . L. For example, consider an audio system with N=6 loudspeakers (called 1, 2, 3, 4, 5, and 6) that is to be used for stereo reproduction (L=2 source signals). Suppose that we require symmetry between loudspeaker 1 and 2, the primary loudspeakers associated with the two source signals (and the symmetric loudspeaker channel pair). Further, suppose that loudspeaker 1 has $S_1=3$ support loudspeakers (2, 3, and 4). Likewise, suppose that loudspeaker 2 has $S_2=4$ support loudspeakers (3, 4, 5, and 6). Hence, the total number of loudspeakers N=6 used in this setup is given by the union of $N_1=S_1+1=4$, i.e., (1, 2, 3, and 4), and $N_2=S_2+1=5$, i.e., (2, 3, 4, 5, and 6), i.e., $N=N_1\cup N_2$.

Recall that if the sound system is represented by a transfer function matrix model, as for example in (1), then each column of $\mathcal{H}_n$ represents the acoustic response of one loudspeaker at M measurement positions. Thus, one of the columns of $\mathcal{H}_n$ contains the responses of the primary loudspeaker, and the rest of the columns contain the responses of the $S_n$ support loudspeakers. Therefore, in a particular design of a compensator for one of the L source inputs, the acoustic model $\mathcal{H}_n$ contains $1+S_n$ columns, and the resulting compensator has one input and $1+S_n$ outputs, where $1+S_n$ may be less than N, depending on how many support loudspeakers were chosen for that particular source input. Note also that it is not necessary to use the same set of loudspeakers repeatedly when compensators are designed for the remaining L−1 source inputs. The number $S_n$ of support loudspeakers used by the compensator may therefore not be the same for all of the L source inputs.

Example of Target Sound Field Definition

The aim of loudspeaker precompensation is not, in general, to generate an arbitrary sound field in a room, but to improve the acoustic response of an existing physical loudspeaker. The target sound field to be defined for one particular (out of L) input source signals is therefore highly determined by the characteristics of the primary loudspeaker associated with that input source signal. The following example is an illustration of how a target sound field can be specified for a specific primary loudspeaker.

Suppose that the sound system in question is measured in M positions, and is represented with a transfer function matrix $\mathcal{H}_n$ as in (1). Moreover, suppose that the jth column of $\mathcal{H}_n$ represents the impulse responses of the considered primary loudspeaker. Then a target sound field can be specified in form of a M×1 column vector of transfer functions, $\mathcal{D}_n$ as in (4). Typically, the target sound field should be specified as an idealized version of the measured impulse responses of the primary loudspeaker. An example of how such an idealized set of impulse responses can be designed is to use delayed unit pulses as elements in $\mathcal{D}_n$, i.e., to let the ith element $\mathcal{D}_{in}$ of $\mathcal{D}_n$ be defined as $\mathcal{D}_{in}(q^{-1})=q^{-d_0-\Delta_{in}}$, where $\Delta_{in}$ is the initial propagation delay of the ith element of the jth column of $\mathcal{H}_n$, i.e., $$\mathcal{D}_n(q^{-1}) = q^{-d_0}\begin{bmatrix} q^{-\Delta_{1n}} \\ \vdots \\ q^{-\Delta_{Mn}} \end{bmatrix} \tag{6}$$

The target response in (6) is an idealized version of the primary loudspeaker's impulse response, in the sense that it represents a sound wave whose propagation through space (i.e., over the M measurement positions) is similar to that of the primary loudspeaker, but in the time domain the shape of the target sound wave is pulse-like and contains no room echoes. The delays $\Delta_{1n}$ . . . , $\Delta_{Mn}$ can be determined by detecting the time lag corresponding to of the first coefficient of non-negligible magnitude in each of the impulse responses in the jth column of $\mathcal{H}_n$. The extra common bulk delay $d_0$ is optional, but should preferably be included if a diagonal phase compensator with lag $d_0$ is used, as suggested in (10), (8).

If there are more than two input source signals, i.e., if L>2, then one target sound field is defined for each of the L signal sources that are to be reproduced by the sound system.

If for some reason the propagation delays $\Delta_{1n}, \ldots, \Delta_{Mn}$ cannot be properly detected, are ambiguous or in any way difficult to define, then some controlled variability can be introduced into the target $\mathcal{D}_n$. For example, the delays $\Delta_{1n}, \ldots, \Delta_{Mn}$ can be adjustable within prescribed limits. Such flexibility of the target can help attain better approximation to the selected target, better criterion values and better perceived audio quality. This type of flexibility can be utilized by adjusting the parameters of the target $\mathcal{D}_n$ and the parameters of the precompensation filter iteratively.

The above example illustrates one of many possibilities to define the target response. For example, the target response may be a virtual sound source instead of a primary loudspeaker, where symmetry is required between pairwise selected virtual sound sources. Another example would be the case when no support loudspeakers are used and aligned channel models are used, i.e. $\Delta_{in}=0$, i=1 . . . M. Further, it is possible to set the target to zero in a subset of the M measurement positions for at least one of the primary loudspeakers.

Example of Definition of Optimization Criterion

Consider the MIMO system introduced in (1)-(6) consisting of two primary loudspeakers. Let $n\in\{1, 2\}$ describe the two primary loudspeakers and recall that the total number of loudspeakers N is given by $N=N_1\cup N_2$, where $N_1$ and $N_2$ are the number of loudspeakers used for each of the primary loudspeakers that are required to be symmetric, or similar. Note that each primary loudspeaker has $N_n-1$ support loudspeakers, and let us introduce the signals, see FIG. 1, $$z_{1n}(k)=V_n(q^{-1})(\mathcal{D}_n(q^{-1})w(k)-\mathcal{H}_n(q^{-1})u_{1n}(k))$$

$$z_{2n}(k)=W_n(q^{-1})u_{2n}(k)$$

$$y_n(k)=\mathcal{H}_{0n}(q^{-1})u_{1n}(k). \tag{7}$$

Here, w(k) is a stationary white noise with zero-mean and covariance $E\{w^2(k)\}=\psi$. The filters $V_n(q^{-1})$ and $W_n(q^{-1})$, of dimensions M×M and $N_n\times N_n$, constitute weighting matrices for the error and control signals, respectively. Furthermore, $\mathcal{H}_n(q^{-1})$ and $\mathcal{H}_{0n}(q^{-1})$, both of dimension $M\times N_n$, are given by (2)-(3). The control signals $u_{1n}(k)$ and $u_{2n}(k)$, of dimension $N_n\times 1$, are given by $$\begin{aligned} u_{1n}(k) &= \mathcal{R}_{tot}(q^{-1}, q)w(k) = \tilde{\Delta}_n(q^{-1})\mathcal{F}_{n*}(q)u_{2n}(k) \\ &= \tilde{\Delta}_n(q^{-1})\mathcal{F}_{n*}(q)\mathcal{R}_n(q^{-1})w(k). \end{aligned} \tag{8}$$

Here, $\mathcal{R}_{tot}(q^{-1}, q)$ is a (optionally noncausal) feedforward compensator whereas $\tilde{\Delta}_n(q^{-1})$, $\mathcal{F}_{n*}(q^{-1})$ and $\mathcal{R}_n(q^{-1})$ are given by $$\tilde{\Delta}_n(q^{-1}) = \mathrm{diag}\left(\left[q^{-(d_0-d_{1n})} \ \ldots \ q^{-(d_0-d_{N_n n})}\right]^T\right) \tag{9}$$

-continued $$\mathcal{F}_n(q^{-1}) = \mathrm{diag}\left(\left[\frac{\bar{F}_{1n}(q^{-1})}{F_{1n}(q^{-1})} \cdots \frac{\bar{F}_{N_n n}(q^{-1})}{F_{N_n n}(q^{-1})}\right]^T\right)$$

$$\mathcal{R}_n(q^{-1}) = [\mathcal{R}_{1n}(q^{-1}) \ldots \mathcal{R}_{N_n n}(q^{-1})]^T.$$

Here, $d_0$ is the same as in (4) and represents the primary bulk delay (or smoothing lag) of the compensated system, whereas $d_{jn}$, j=1, . . . , $N_n$ are delays that can be used to compensate for individual deviations in distances among the different loudspeakers. According to [5, 6], $\mathcal{F}_{n*}(q^{-1})$ in (9) is here constructed from excess phase zeros that are common among the RTFs of each of the $N_n$ loudspeakers for all measurement positions in Ω. That is, the elements $B_{1jn}, \ldots, B_{Mjn}$ of the jth column of $B_n$, see (5), are assumed to share a common excess phase factor $\bar{F}_j(q^{-1})$.

Since $\tilde{\Delta}_n(q^{-1})\mathcal{F}_{n*}(q)$ is fixed and known it can be regarded as a factor of an augmented system $$\tilde{\mathcal{H}}_n(q^{-1}) \triangleq \mathcal{H}_n(q^{-1})\tilde{\Delta}_n(q^{-1})\mathcal{F}_{n*}(q) = \tilde{B}A^{-1}, \tag{10}$$

with $\mathcal{H}_n(q^{-1})$ is given by (3).

Figure 2:
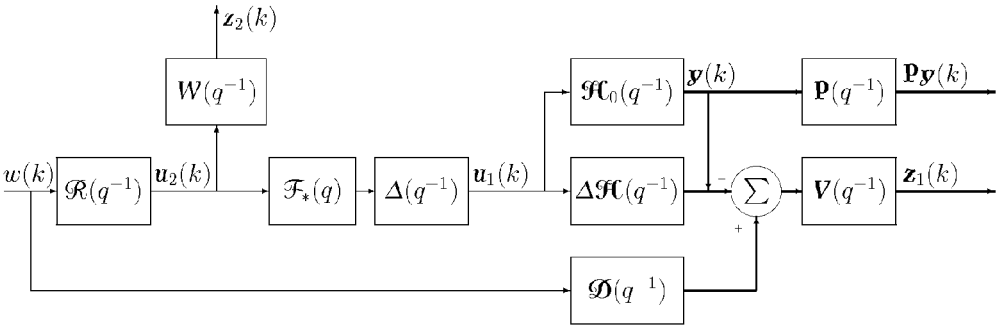
FIG. 2 describes a channel similarity MIMO controller design in block matrix form.

The objective is now to design the controllers $\mathcal{R}_n(q^{-1})$ so as to attain the targets of the respective channels while making the nominal compensated channel responses, see FIG. 2, as similar as possible. In other words, the aim is to minimize the criterion $$J=\bar{E}\{tr\,E[(z_{11})(z_{11})^T]\}+tr\,E[(z_{12})(z_{12})^T]+\{tr\,E[(z_{21})(z_{21})^T]\}+\{tr\,E[(z_{22})(z_{22})^T]\}+\{tr\,E[(P_1y_1-P_2y_2)(P_1y_1-P_2y_2)^T]\}. \tag{11}$$

Here $\bar{E}$ and E denote, respectively, expectation with respect to the uncertain parameters in $\Delta B_n$, see (3), and the driving noise w(k). The matrix $P_n$, of dimension M×M, constitutes a permutation matrix, which can be used to rearrange the signals in $y_n$ according to the symmetry of the control points with regard to the loudspeaker pair. Furthermore, $P_n$ constitutes a weighting matrix to regulate the control points that take similarity into account in both frequency and space.

Block Matrix Notation

The optimization problem, as expressed by minimization of (11), can be formulated more compactly by defining the following block matrices.

$$z_1 \triangleq \begin{bmatrix} z_{11} \\ z_{12} \end{bmatrix} \quad z_2 \triangleq \begin{bmatrix} z_{21} \\ z_{22} \end{bmatrix} \tag{12}$$

$$u_1 \triangleq \begin{bmatrix} u_{11} \\ u_{12} \end{bmatrix} \quad u_2 \triangleq \begin{bmatrix} u_{21} \\ u_{22} \end{bmatrix} \quad \bar{y} \triangleq \begin{bmatrix} y_1 \\ y_2 \end{bmatrix}$$

$$\mathcal{D} \triangleq \begin{bmatrix} \mathcal{D}_1 \\ \mathcal{D}_2 \end{bmatrix} = DE^{-1} = \begin{bmatrix} D_1E_2 \\ D_2E_1 \end{bmatrix}(E_1E_2)^{-1}$$

$$\mathcal{R} \triangleq \begin{bmatrix} \mathcal{R}_1 \\ \mathcal{R}_2 \end{bmatrix} \quad p \triangleq [P_1 \mid -P_2]$$

$$\tilde{\Delta} \triangleq \begin{bmatrix} \tilde{\Delta}_1 & 0 \\ 0 & \tilde{\Delta}_2 \end{bmatrix} \quad \mathcal{F} \triangleq \begin{bmatrix} \mathcal{F}_1 & 0 \\ 0 & \mathcal{F}_2 \end{bmatrix}$$

$$V \triangleq \begin{bmatrix} V_1 & 0 \\ 0 & V_2 \end{bmatrix} \quad W \triangleq \begin{bmatrix} W_1 & 0 \\ 0 & W_2 \end{bmatrix}$$

where $z_1$, y, and $\mathcal{D}$, all have dimension 2M×1, $u_1$, $u_2$, $z_2$ and $\mathcal{R}$ all have dimension $(N_1+N_2)\times 1$, P has dimension M×2M, W, $\tilde{\Delta}$ and $\mathcal{F}$ all have dimension $(N_1+N_2)\times(N_1+N_2)$, whereas V has dimension 2M×2M. Further, we define, according to (2)-(3), $$\begin{aligned}
\mathcal{H} &\triangleq \begin{bmatrix} \mathcal{H}_1 & 0 \\ 0 & \mathcal{H}_2 \end{bmatrix} = \mathcal{H}_0 + \Delta\mathcal{H} \\
&\triangleq \begin{bmatrix} \mathcal{H}_{01} & 0 \\ 0 & \mathcal{H}_{02} \end{bmatrix} + \begin{bmatrix} \Delta\mathcal{H}_1 & 0 \\ 0 & \Delta\mathcal{H}_2 \end{bmatrix} \\
&= (\hat{B}_0 + \Delta B\hat{B}_1)(A_0A_1)^{-1} \\
&\triangleq \left(\begin{bmatrix} \hat{B}_{01} & 0 \\ 0 & \hat{B}_{02} \end{bmatrix} + \begin{bmatrix} \Delta B_1 & 0 \\ 0 & \Delta B_2 \end{bmatrix}\begin{bmatrix} \hat{B}_{11} & 0 \\ 0 & \hat{B}_{12} \end{bmatrix}\right)\times \\
&\left(\begin{bmatrix} A_{01} & 0 \\ 0 & A_{02} \end{bmatrix}\begin{bmatrix} A_{11} & 0 \\ 0 & A_{12} \end{bmatrix}\right)^{-1} \triangleq BA^{-1},
\end{aligned} \tag{13}$$

where $\mathcal{H}$, $\mathcal{H}_0$, $\Delta\mathcal{H}$, B, $\hat{B}_0$ and ΔB all have dimension $2M\times(N_1+N_2)$, whereas $\hat{B}_1$, $A_0$, $A_1$ and A all have dimension $(N_1+N_2)\times(N_1+N_2)$. We can now express the signals in (7) and (8) more compactly on block matrix form as, see FIG. 2, $$\begin{aligned}
z_1(k) &= V(q^{-1})(\mathcal{D}(q^{-1})w(k) - \tilde{\mathcal{H}}(q^{-1})u_2(k)) \\
z_2(k) &= W(q^{-1})u_2(k) \\
y(k) &= \mathcal{H}_0(q^{-1})u_1(k) \\
u_1(k) &= \tilde{\Delta}(q^{-1})\mathcal{F}_*(q)u_2(k) \\
&= \tilde{\Delta}(q^{-1})\mathcal{F}_*(q)\mathcal{R}(q^{-1})w(k) \\
&\triangleq \mathcal{R}_{tot}(q^{-1}, q)w(k).
\end{aligned} \tag{14}$$

Here, again, since $\tilde{\Delta}\mathcal{F}_*$ is fixed and known it is regarded as a factor of an augmented system $$\tilde{\mathcal{H}}(q^{-1}) \triangleq \mathcal{H}(q^{-1})\tilde{\Delta}(q^{-1})\mathcal{F}_*(q) = \tilde{B}(q^{-1})A^{-1}(q^{-1}) \tag{15}$$

The second equality in (15) is allowed because A, $\tilde{\Delta}$ and $\mathcal{F}_*$ are all diagonal. By invoking (3) and (13) we get $$\tilde{B}=\tilde{\hat{B}}_0+\Delta B\tilde{\hat{B}}_1=(\hat{B}_0+\Delta B\hat{B}_1)\tilde{\Delta}\mathcal{F}_* \triangleq B\tilde{\Delta}\mathcal{F}_*; \tag{16}$$

with $\tilde{\hat{B}}_0=\hat{B}_0\tilde{\Delta}\mathcal{F}_*$ and $\tilde{\hat{B}}_1=\hat{B}_1\tilde{\Delta}\mathcal{F}_*$.

According to (12)-(16) we can now formulate (11) as a more compact criterion $$J=\bar{E}\{trE[(z_1)(z_1)^T]+trE[(z_2)(z_2)^T]+tr\,E[(Py)(Py)^T]\}. \tag{17}$$

In view of (17), the objective is now to design the controller $\mathcal{R}(q^{-1})$ so as to attain the target $\mathcal{D}(q^{-1})$ while making the nominal compensated channel responses y(k) as similar as possible. This is obtained by minimizing the criterion in (17).

Optimal Controller Design

The criterion (17), which constitutes a squared 2-norm, or other forms of criteria, based e.g., on other norms, can be optimized in several ways with respect to the adjustable parameters of the precompensator $\mathcal{R}$. It is also possible to impose structural constraints on the precompensator, such as e.g., requiring its elements to be FIR filters of certain fixed orders, and then perform optimization of the adjustable parameters under these constraints. Such optimization can be performed with adaptive techniques, or by the use of FIR Wiener filter design methods. However, as all structural constraints lead to a constrained solution space, the attainable performance will be inferior compared with problem formulations without such constraints. Hence, the optimization should preferably be performed without structural constraints on the precompensator, except for causality of the precompensator and stability of the compensated system. With the optimization problem stated as above, the problem becomes a Linear Quadratic Gaussian (LQG) design problem for the multivariable feedforward compensator $\mathcal{R}$.

Linear quadratic theory provides optimal linear controllers, or precompensators, for linear systems and quadratic criteria, see e.g., [1, 13, 14, 18]. If the involved signals are assumed to be Gaussian, then the LQG precompensator, obtained by optimizing the criterion (17) can be shown to be optimal not only among all linear controllers but also among all nonlinear controllers, see e.g., [1]. Hence, optimizing the criterion (17) with respect to the adjustable parameters of $\mathcal{R}$, under the constraint of causality of $\mathcal{R}$ and stability of the compensated system $\mathcal{H}\mathcal{R}$, is very general. With $\mathcal{H}$ and $\mathcal{D}$ assumed stable, stability of the compensated system, or error transfer operator, $\mathcal{D}-\mathcal{H}\mathcal{R}$, is thus equivalent to stability of the controller $\mathcal{R}$.

We will now present the LQG-optimal precompensator for the problem defined by equations (1)-(16) and the criterion (17). The solution is given in transfer operator, or transfer function form, using polynomial matrices. Techniques for deriving such solutions has been presented in e.g., [18]. Alternatively, the solution can be derived by means of state space techniques and the solution of Riccati equations, see e.g., [1, 14].

Polynomial Matrix Design Equations for Optimizing Precompensators

Given the system $\widetilde{\mathcal{H}}(q^{-1})$ above, with the fixed and known delay polynomial matrix $\tilde{\Delta}(q^{-1})$, the all-pass rational matrix $\mathcal{F}_*(q)$, and assuming the signal w(t) being a zero mean unit variance white noise sequence, then the optimal LQG-precompensator $\mathbb{R}(q^{-1})$, free of preringing artifacts, which minimizes the criterion (17) under the constraint of causality and stability, is obtained as, $$\mathcal{R} = \tilde{\Delta}\beta^{-1}Q\frac{1}{E} \tag{18}$$

where $\beta$, of dimension $(N_1+N_2)\times(N_1+N_2)$, is the unique (up to a unitary constant matrix) stable spectral factor of $$\beta_*\beta=\bar{E}\{\tilde{B}_*V_*V\tilde{B}+A_*W_*WA+\tilde{\hat{B}}_{0*}P_*P\tilde{\hat{B}}_0\} \tag{19}$$

with $\tilde{B}$, of dimension $2M\times(N_1+N_2)$, being as in (16). The polynomial matrix Q, together with a polynomial matrix $L_*$, both of dimension $(N_1+N_2)\times 1$, constitute the unique solution to the Diophantine equation $$\bar{E}\{\tilde{\hat{B}}_{0*}\}V_*VD=\beta_*Q+qL_*E \tag{20}$$

with generic degrees $$\deg Q=\max(\deg V+\deg D, \deg E-1)$$

$$\deg L_*=\max(\deg \bar{E}\{\tilde{\hat{B}}_{0*}\}+\deg V_*, \deg \beta_*)-1. \tag{21}$$

In a practical controller design, the first term on the right hand side of the spectral factorization (19) can by substitution of (16) be written as, $$\bar{E}\{\tilde{B}_*V_*V\tilde{B}\}=\tilde{\hat{B}}_{0*}V_*V\tilde{\hat{B}}_0+\tilde{\hat{B}}_{1*}\bar{E}\{\Delta B_*V_*V\Delta B\}\tilde{\hat{B}}_1. \tag{22}$$

The last term in (22) is readily obtained by evaluating, see [17, 16, 19] for details, $$\bar{E}\{\Delta B_*V_*V\Delta B\}_{(i,j)}=trV_*V\bar{E}\{\Delta B_{(:,j)}\Delta B_{(:,j)*}\}. \tag{23}$$

The random coefficients of the polynomial elements of $\Delta B$ are defined as zero-mean white noise sequences with variances so that $\bar{E}\{\Delta B\Delta B_*\}_{(i,j)}$ is 1 for i=j and 0 for i≠j. If $V_*V$ is diagonal, then this yields the numerically computable expression $$\bar{E}\{\Delta B_*V_*V\Delta B\}=I_{(N_1+N_2)}tr\ V_*V. \tag{24}$$

Post-Processing for a Balanced Magnitude Spectrum

When a sound system is reproducing music, it is mostly preferable that the magnitude spectrum of the system's transfer functions is smooth and well balanced, at least on average over the listening region. If the compensated system perfectly attains the desired target $\mathcal{D}$ at all positions, then the average magnitude response of the compensated system will be equal to that of the target. However, since the designed controller $\mathbb{R}$ cannot be expected to fully reach the target response $\mathcal{D}$ at all frequencies, e.g., due to very complex room reverberation that cannot be fully compensated for, there will always be some remaining approximation errors in the compensated system. These approximation errors may have different magnitude at different frequencies, and they may affect the quality of the reproduced sound. Magnitude response imperfections are generally undesirable and the controller matrix should preferably be adjusted so that an overall target magnitude response is reached on average in all the listening regions.

A final design step is therefore preferably added after the criterion minimization with the aim of adjusting the controller response so that, on average, a target magnitude response is well approximated on average over the measurement positions. To this end, the magnitude responses of the overall system (i.e., the system including the controller $\mathbb{R}$) can be evaluated in the various listening positions, based on the design models or based on new measurements. A minimum phase filter can then be designed so that on average (in the RMS sense) the target magnitude response is reached in all listening regions. As an example, variable fractional octave smoothing based on the spatial response variations may be employed in order not to overcompensate in any particular frequency region. The result is one scalar equalizer filter that adjusts all the elements of $\mathbb{R}$ by an equal amount.

AN ILLUSTRATIVE EXAMPLE

Figure 13:
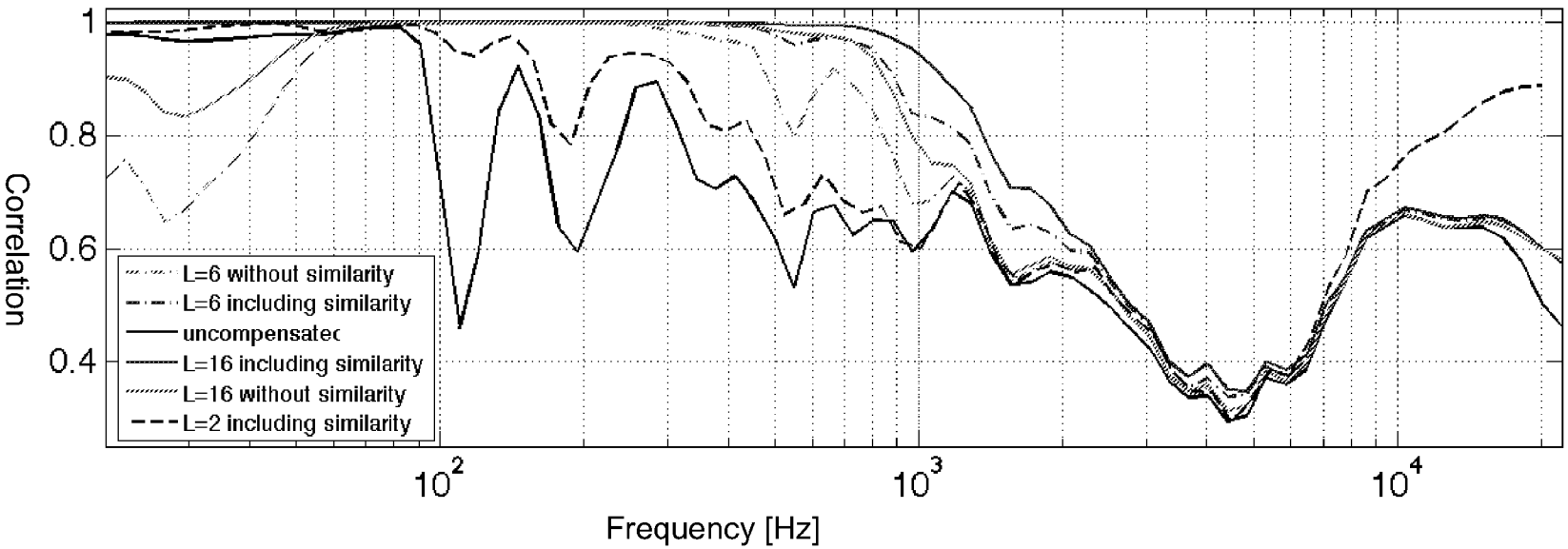
FIG. 13 illustrates another design example. Shown is the cross correlation between two primary loudspeakers, left and right, for a varying number of support loudspeakers used and for two scenarios, one with and the other without taking channel similarity into account. The cross correlation was evaluated in M=64 measurement positions in a room in frequency bands corresponding to the critical bandwidth describing the effective bandwidth of the auditory filter [15]. The measurement positions were distributed on a uniform grid with 10 cm spacing, constituting a measurement volume of 30×30×30 cm.

The performance of the suggested precompensator design is shown by means of measurements of two example implementations. FIG. 7-12 illustrate the first example, FIG. 13 shows the second example. In the examples, similarity is illustrated by means of cross correlation. The higher the value of the cross correlation between two channels, the higher the similarity of the two channels.

Figure 7:
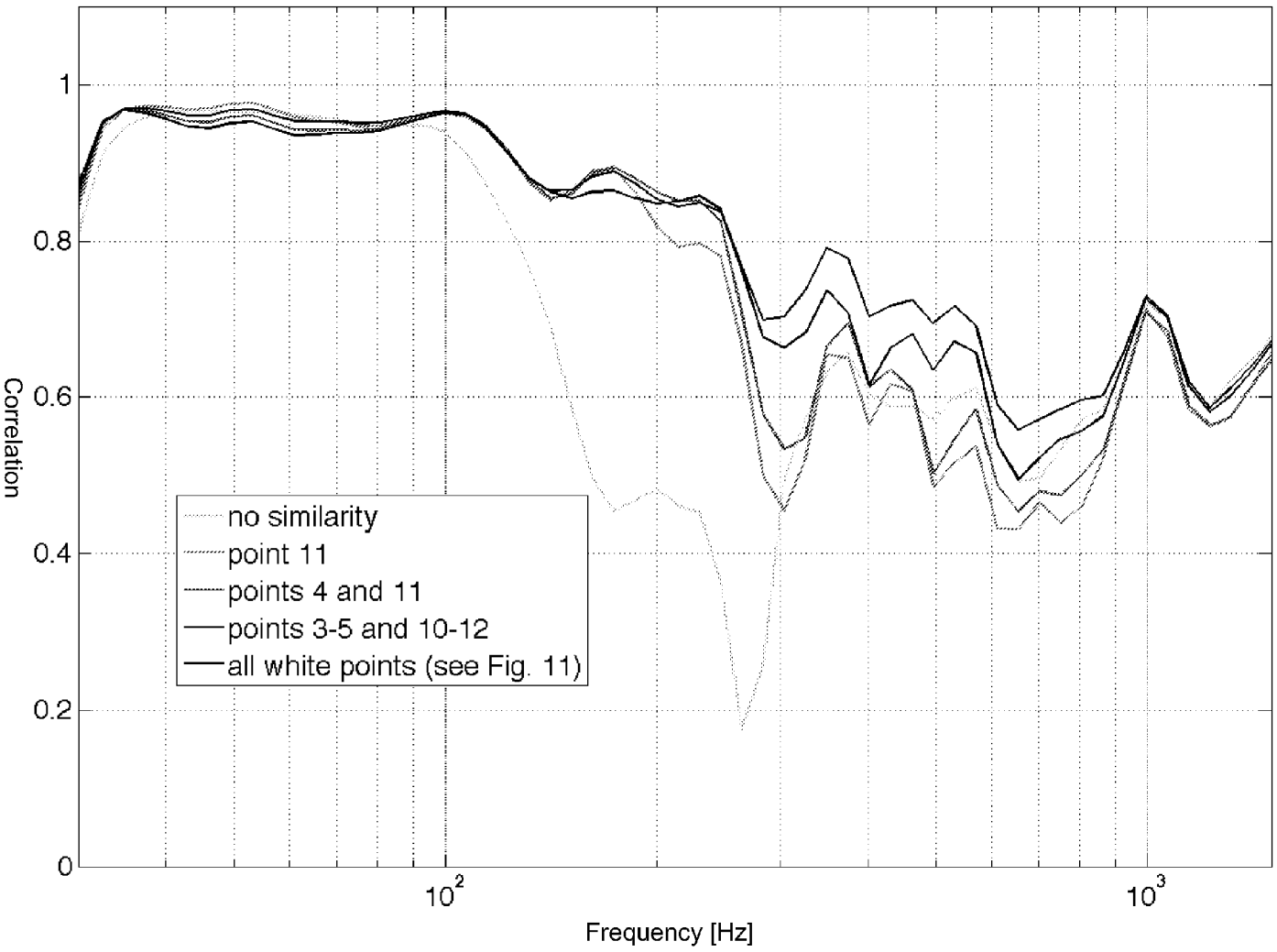
FIG. 7 illustrates a design example. Shown is the cross correlation between two loudspeakers, left and right, evaluated in 30 measurement points in a room in frequency bands corresponding to the critical bandwidth describing the effective bandwidth of the auditory filter [15].

FIG. 7 shows similarity measured by the cross correlation between loudspeaker left and right (which should ideally be equal to unity for all frequencies) evaluated in 30 measurement points in a room in frequency bands corresponding to the critical bandwidth describing the effective bandwidth of the auditory filter [15]. Several designs, where channel similarity was concerned in a varying number of control points were assessed, see FIG. 12. It can be seen that the design based on channel similarity in only one point already gives a significant raise in the correlation between the two channels. It is further shown that the correlation increases with the number of control points that take channel similarity into account.

Figure 8:
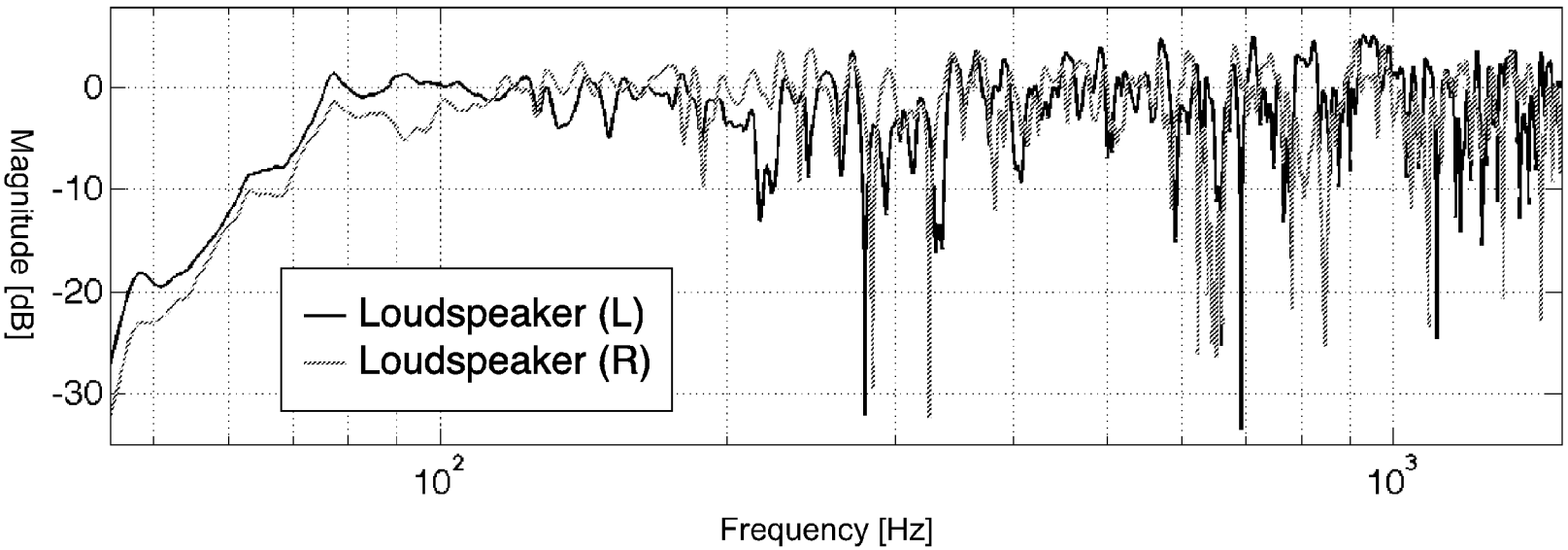
FIG. 8 illustrates a design example. Shown are the frequency responses of two loudspeakers, left and right, for designs based on and evaluated in one measurement point for a traditional equalization design where channel similarity was not concerned.
Figure 9:
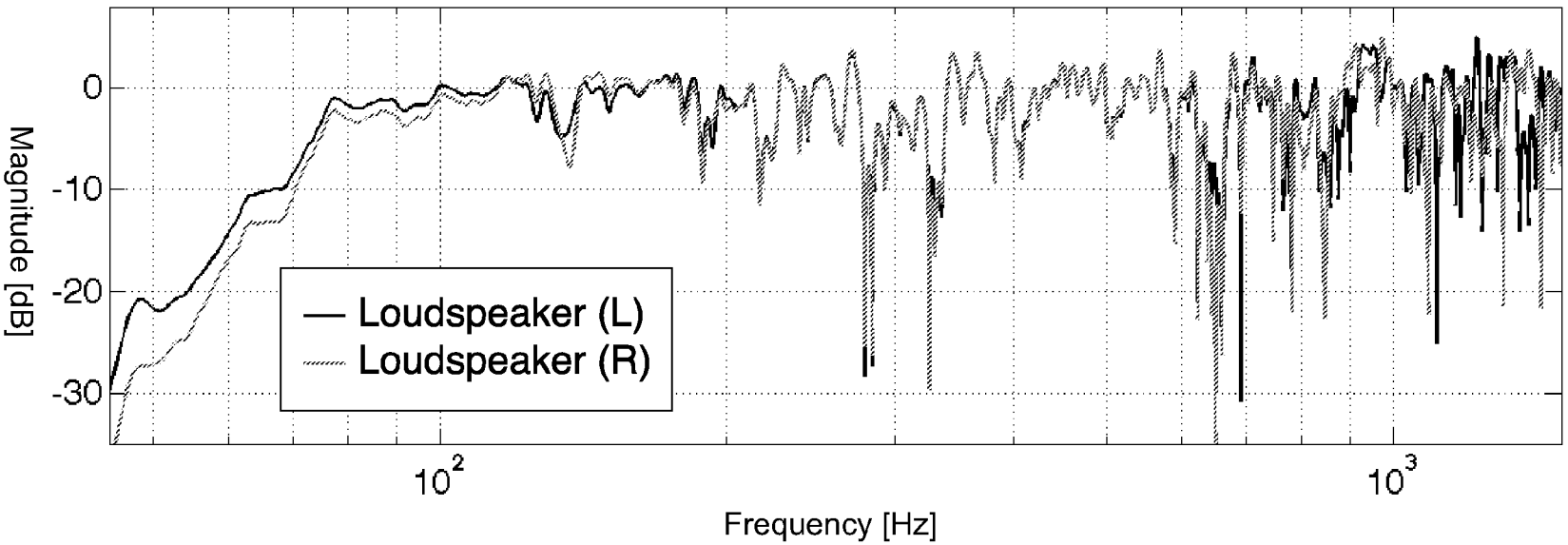
FIG. 9 illustrates a design example. Shown are the frequency responses of two loudspeakers, left and right, for designs based on and evaluated in one measurement point for a design including channel similarity in the criterion function.

FIG. 8 and FIG. 9 show the frequency responses of loudspeakers (L) and (R) for designs based on, and evaluated in, one measurement point. FIG. 8 shows a design where channel similarity was not taken into account whereas FIG. 9 shows a design including channel similarity in the criterion function. The design based on channel similarity in solely one point results in almost identical frequency responses of the two channels in the range 70-800 Hz.

Figure 10:
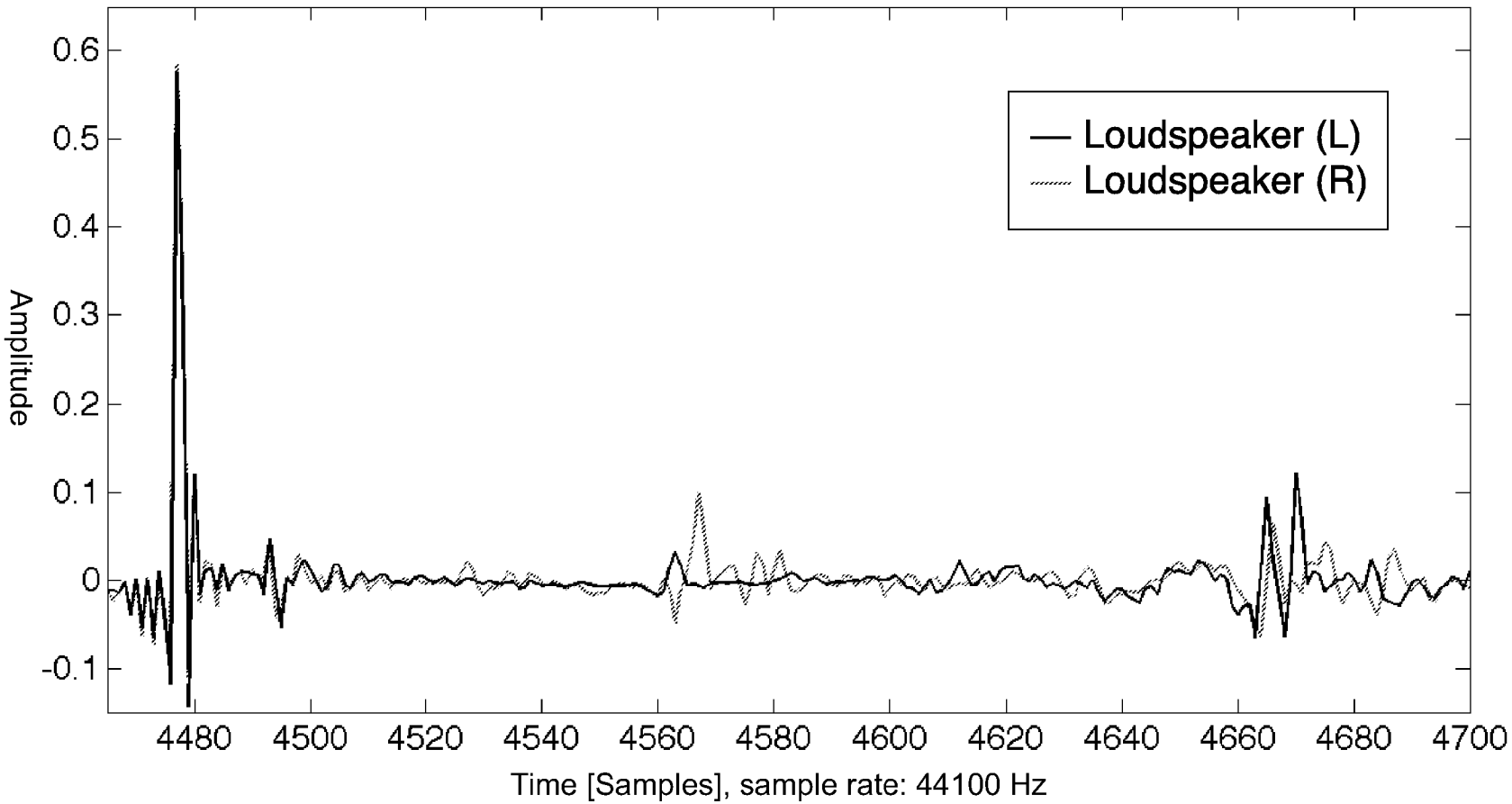
FIG. 10 illustrates a design example. Shown are the impulse responses of two loudspeakers, left and right, for designs based on, and evaluated in, one measurement point, where the design was not taking channel similarity into account.
Figure 11:
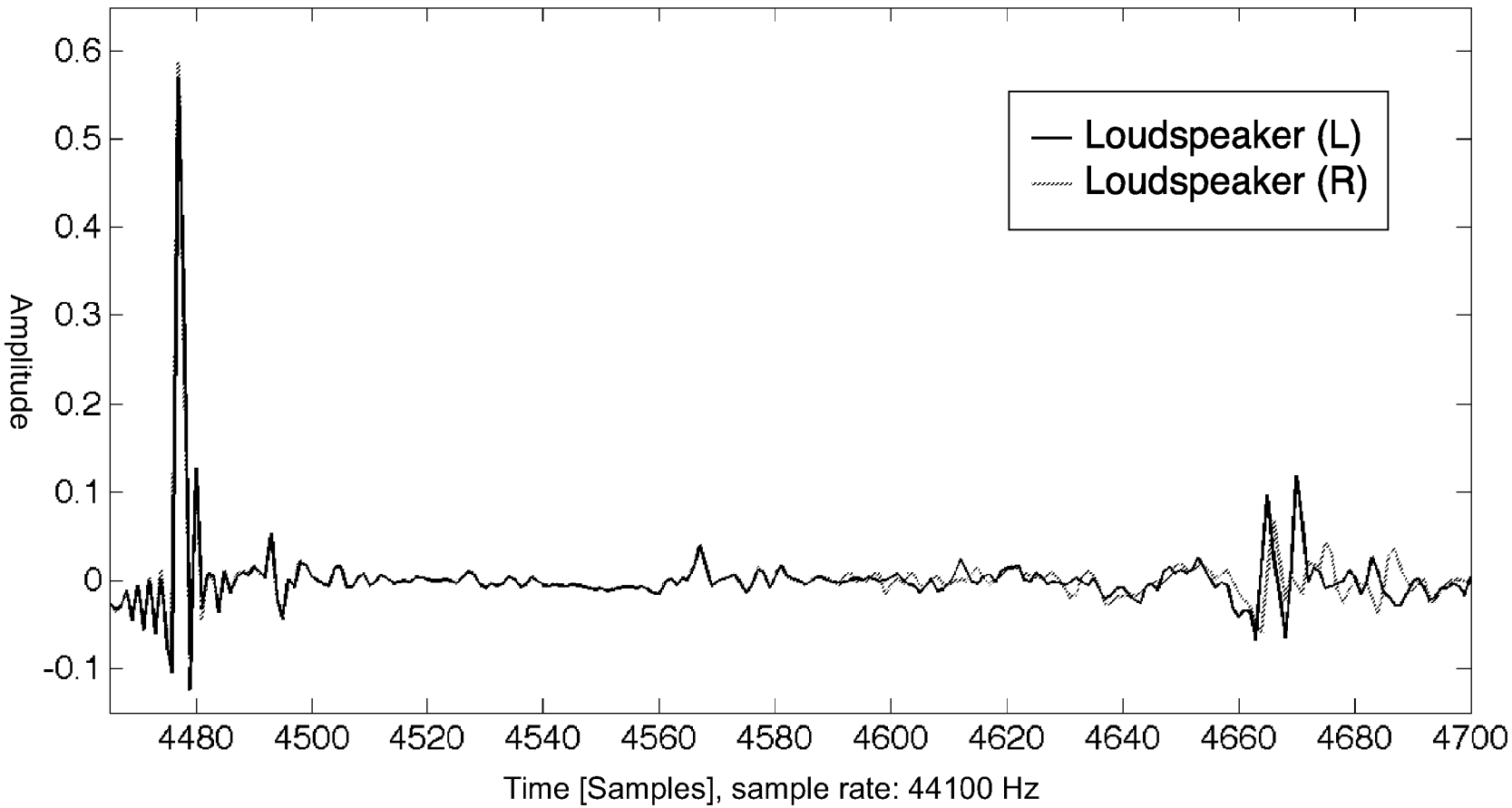
FIG. 11 illustrates a design example. Shown are the impulse responses of two loudspeakers, left and right, for designs based on and evaluated in one measurement point, where the design includes channel similarity in the criterion function.
Figure 12:
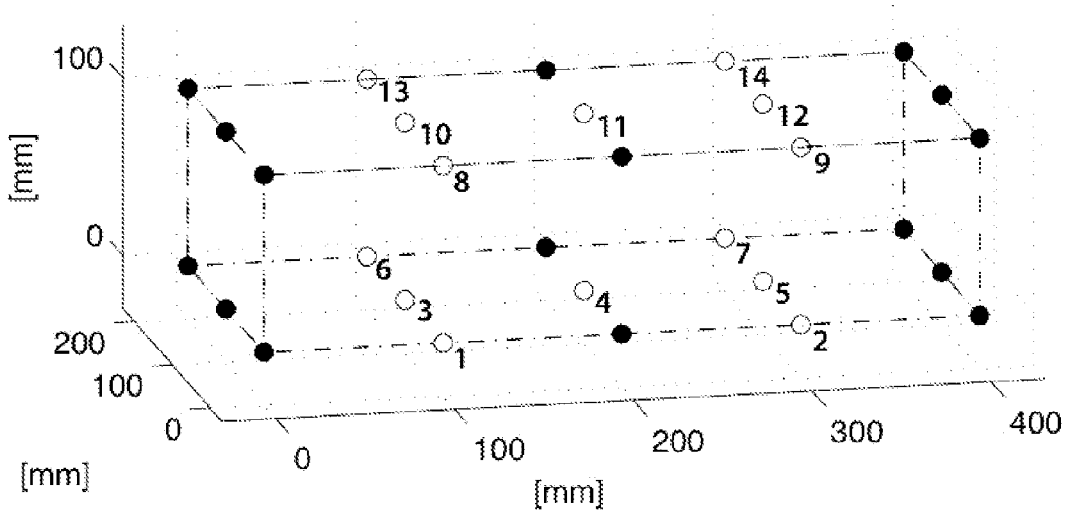
FIG. 12 shows the M=30 measurement positions used in the design experiment. They were distributed on a uniform grid with 10 cm spacing, constituting a measurement volume Ω of 40×20×10 cm. Channel similarity was taken into account in either a subset of, or all the white points.

FIG. 10 and FIG. 11 show the impulse responses of loudspeakers (L) and (R) for designs based on and evaluated in one measurement point. FIG. 10 shows a design where channel similarity was not concerned whereas FIG. 11 shows a design including channel similarity in the criterion function. In the time domain, similarity is achieved for about 200 Samples at 44100 Hz sampling rate.

In FIG. 13 one can see the cross correlation between two primary loudspeakers, left and right, for a varying number of support loudspeakers used and for two different scenarios, one with and one without pairwise channel similarity taken into account. The cross correlation was evaluated in 64 measurement positions in a room in frequency bands corresponding to the critical bandwidth describing the effective bandwidth of the auditory filter [15]. The measurement positions were distributed on a uniform grid with 10 cm spacing, constituting a measurement volume of 30×30×30 cm. It can be seen that the cross correlation raises with the amount of support loudspeakers used. It is important to note that the cross correlation for a precompensator design with similarity for six loudspeakers is higher than the cross correlation for a precompensator design without similarity for 16 loudspeakers.

Filter Implementation

The resulting filter $\mathcal{R}$ of (18) can be realized in any number of ways, in state space form or in transfer function form. The required filters are in general of very high order, in particular if a full audio range sampling rate is used and if also room acoustic dynamics have been taken into account in the model on which the design is based. To obtain a computationally feasible design, methods for limiting the computational complexity of the precompensator are of interest. We here outline one method for this purpose that is based on controller order reduction of elements of the controller matrix $\mathcal{R}$, in particular of any transfer functions that have impulse responses with very long but smooth tails. The method works as follows.

The relevant scalar impulse response elements $\mathcal{R}_{1n}, \ldots, \mathcal{R}_{N_n n}$ of the pre-compensator $\mathcal{R}$ are first represented as very long FIR filters, as mentioned above. Then, for each precompensator impulse response $\mathcal{R}_{jn}$, do the following:

1. Determine a lag $t_1>1$ after which the impulse response is approximately exponentially decaying and has a smooth shape, and a second lag $t_2>t_1$ after which the impulse response coefficients are negligible.
2. Use a model reduction or system identification technique to adjust a low-order recursive IIR filter to approximate the FIR filter tail for a delay interval $[t_1, t_2]$
3. Realize the approximated scalar precompensator filter as a parallel connection $R_{jn}(q^{-1})=M(q^{-1})+q^{-t_1}N(q^{-1})$, where $M(q^{-1})$ is a FIR filter that equals the first $t_1$ impulse response coefficients of the original FIR filter $\mathcal{R}_j(q^{-1})$, from lag zero to lag $t_1-1$, while $N(q^{-1})$ is the IIR filter that approximates its tail.

The aim of this procedure is to obtain realizations in which the sum of the number of parameters in the FIR filter $M(q^{-1})$ and the IIR filter $N(q^{-1})$ is much lower than the original number of impulse response coefficients. Various different methods for approximating the tail of the impulse response can be used, for example adjustment of autoregressive models to a covariance sequence based on the Yule-Walker equations. To obtain low numerical sensitivity to rounding errors of coefficients when implementing the resulting IIR filters with finite precision arithmetic, it is preferable to implement them as parallel connections or series connections of lower order filters. As an example, first order filters or second order IIR filter elements (so-called biquadratic filters) may be used.

Implementation Aspects

Typically, the design methodology is executed on a computer system to produce the filter parameters of the precompensation filter. The calculated filter parameters are then normally downloaded to a digital filter, for example realized by a digital signal processing system or similar computer system, which executes the actual filtering.

Although the invention can be implemented in software, hardware, firmware or any combination thereof, the filter design scheme proposed by the invention is preferably implemented as software in the form of program modules, functions or equivalent. The software may be written in any type of computer language, such as C, C++ or even specialized languages for digital signal processors (DSPs). In practice, the relevant steps, functions and actions of the invention are mapped into a computer program, which when being executed by the computer system effectuates the calculations associated with the design of the precompensation filter. In the case of a PC-based system, the computer program used for the design or determination of the audio precompensation filter is normally encoded on a computer-readable medium such as a DVD, CD or similar structure for distribution to the user/filter designer, who then may load the program into his/her computer system for subsequent execution. The software may even be downloaded from a remote server via the Internet.

According to a first aspect, there is thus provided a system, and corresponding computer program product, for determining an audio precompensation controller for an associated sound generating system, including at least one symmetrical loudspeaker channel pair, comprising a total of N≥2 loudspeakers, each having a loudspeaker input, where the audio precompensation controller has a number L≥2 inputs for L input signals and N outputs for N controller output signals, one to each loudspeaker of the sound generating system. The audio precompensation controller has a number of adjustable filter parameters to be determined. The system basically comprises means for estimating, for each one of at least a subset of the N loudspeaker inputs, an impulse response at each of a plurality M≥2 of measurement positions, distributed in a region of interest in a listening environment, based on sound measurements at the M measurement positions. The system also comprises means for specifying, for each one of the L input signal(s), a selected one of the N loudspeakers as a primary loudspeaker and optionally also a selected subset S including at least one of the N loudspeakers as support loudspeaker(s), where the primary loudspeaker is not part of the subset, and means for specifying at least one pair of primary loudspeakers that is required to be symmetric with respect to the listening position. The system further comprises means for specifying, for each primary loudspeaker, a target impulse response at each of the M measurement positions. The system also comprises means for determining, for each one of the L input signal(s), based on the selected primary loudspeaker and the optionally selected support loudspeaker(s), filter parameters of the audio precompensation controller so that a criterion function, which takes pairwise channel similarity into account, is optimized under the constraint of stability of the dynamics of the audio precompensation controller. Preferably, the criterion function is defined to include a weighted summation of powers of differences between the compensated estimated impulse responses and the target impulse responses over the M measurement positions and a weighted and permuted summation of powers of differences between at least one pair of equalized symmetrical RTFs.

The system may also include means for merging all of the filter parameters, determined for the L controller input signals, into a merged set of filter parameters for the audio precompensation controller, especially if there are three or more input signals, i.e. $L \geq 3$. The audio precompensation controller, with the merged set of filter parameters, is then configured for operating on the L input signals to generate the N controller output signals to the loudspeakers to attain the desired target impulse responses.

In a particular example, the means for determining filter parameters of the audio precompensation controller is configured to operate based on a Linear Quadratic Gaussian (LQG) optimization of the parameters of a stable, linear and causal multivariable feedforward controller based on a given target dynamical system, a similarity condition, and a dynamical model of the sound generating system.

The proposed technology embodies a number of special design choices. For example, in the weighted summation of powers of differences between the compensated estimated impulse response and the target impulse response, some or all of the weights can be selected to zero. If all weights are zero, then the weighted summation of powers of differences between the compensated estimated impulse response and the target impulse response is disregarded in the criterion function. Further, the weights can be chosen such that only one of the M measurement positions is considered in the criterion function, which corresponds to the situation of having performed only one measurement.

Another example is when only one mono signal is available as source signal. Then the L input signals to the controller can be fed with this mono signal. In other words, the mono signal is then split into L identical signals, which are fed into the L controller inputs. If this split operation is regarded as a part of the controller, then the controller can be viewed as having one mono input.

According to a second aspect, there is thus provided a system, and corresponding computer program product, for determining an audio precompensation controller for an associated sound generating system comprising a total of $N \geq 2$ loudspeakers, each having a loudspeaker input, has a number L inputs for L input signal(s) and N outputs for N controller output signals, one to each loudspeaker of said sound generating system. In general, the audio precompensation controller has a number of adjustable filter parameters. The system comprises means for estimating, for each one of at least a subset of the N loudspeaker inputs, an impulse response at measurement position(s) in a listening environment, based on sound measurements at the measurement position(s). Also, the system comprises means for specifying at least one loudspeaker pair, where said loudspeaker pair is required to be symmetric, or similar, with respect to the listening position. The system also comprises means for determining, for each one of said L input signals, based on the selected loudspeaker pair, filter parameters of the audio precompensation controller so that a criterion function is optimized under the constraint of stability of the dynamics of the audio precompensation controller. The criterion function includes a weighted and permuted summation of powers of differences between at least one pair of equalized symmetrical room transfer functions (RTFs). In other words, the equalized symmetrical RTFs correspond to compensated estimated impulse responses.

The computer program product comprises corresponding program means, and is configured for determining the audio precompensation controller when running on a computer system.

Figure 4:
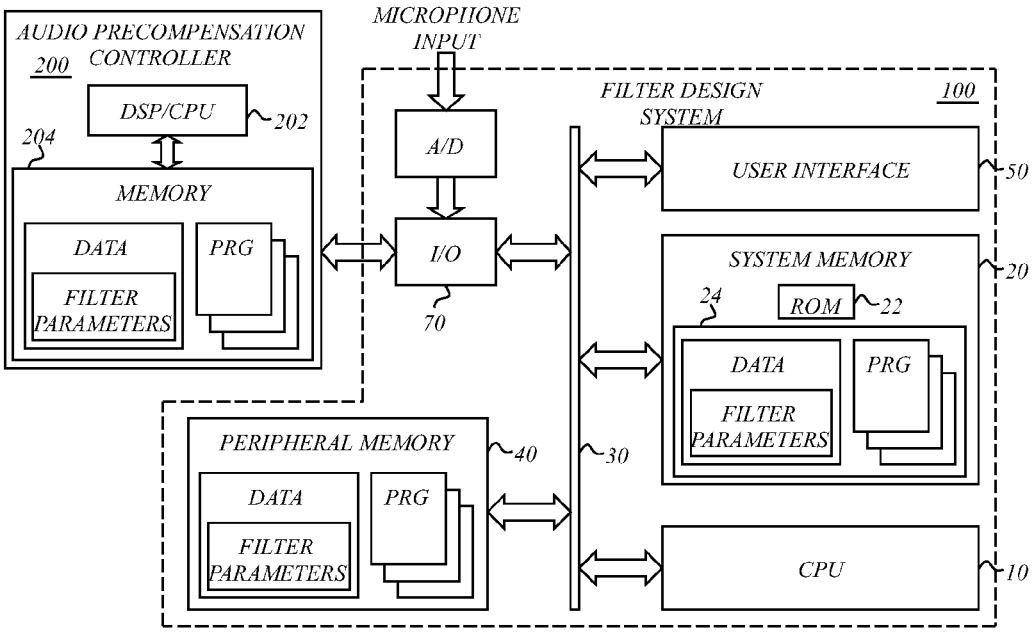
FIG. 4 is a schematic block diagram of an example of a computer-based system suitable for implementation of the invention.

FIG. 4 is a schematic block diagram illustrating an example of a computer system suitable for implementation of a filter design algorithm according to the invention. The filter design system 100 may be realized in the form of any conventional computer system, including personal computers (PCs), mainframe computers, multiprocessor systems, network PCs, digital signal processors (DSPs), and the like. Anyway, the system 100 basically comprises a central processing unit (CPU) or digital signal processor (DSP) core 10, a system memory 20 and a system bus 30 that interconnects the various system components. The system memory 20 typically includes a read only memory (ROM) 22 and a random access memory (RAM) 24. Furthermore, the system 100 normally comprises one or more driver-controlled peripheral memory devices 40, such as hard disks, magnetic disks, optical disks, floppy disks, digital video disks or memory cards, providing non-volatile storage of data and program information. Each peripheral memory device 40 is normally associated with a memory drive for controlling the memory device as well as a drive interface (not illustrated) for connecting the memory device 40 to the system bus 30. A filter design program implementing a design algorithm according to the invention, optionally together with other relevant program modules, may be stored in the peripheral memory 40 and loaded into the RAM 24 of the system memory 20 for execution by the CPU 10. Given the relevant input data, such as measurements, input specifications, and optionally a model representation and other optional configurations, the filter design program calculates the filter parameters of the audio precompensation controller/filter.

The determined filter parameters are then normally transferred from the RAM 24 in the system memory 20 via an I/O interface 70 of the system 100 to an audio precompensation controller 200. Preferably, the audio precompensation controller 200 is based on a digital signal processor (DSP) or similar central processing unit (CPU) 202, and one or more memory modules 204 for holding the filter parameters and the required delayed signal samples. The memory 204 normally also includes a filtering program, which when executed by the processor 202, performs the actual filtering based on the filter parameters.

Instead of transferring the calculated filter parameters directly to the audio precompensation controller 200 via the I/O system 70, the filter parameters may be stored on a peripheral memory card or memory disk 40 for later distribution to an audio precompensation controller, which may or may not be remotely located from the filter design system 100. The calculated filter parameters may also be downloaded from a remote location, e.g. via the Internet, and then preferably in encrypted form.

In order to enable measurements of sound produced by the audio equipment under consideration, any conventional microphone unit(s) or similar recording equipment may be connected to the computer system 100, typically via an analog-to-digital (A/D) converter. Based on measurements of (conventional) audio test signals made by the microphone unit, the system 100 can develop a model of the audio system, using an application program loaded into the system memory 20. The measurements may also be used to evaluate the performance of the combined system of precompensation filter and audio equipment. If the designer is not satisfied with the resulting design, he may initiate a new optimization of the precompensation filter based on a modified set of design parameters.

Furthermore, the system 100 typically has a user interface 50 for allowing user-interaction with the filter designer. Several different user-interaction scenarios are possible.

For example, the filter designer may decide that he/she wants to use a specific, customized set of design parameters in the calculation of the filter parameters of the audio precompensation controller 200. The filter designer then defines the relevant design parameters via the user interface 50.

It is also possible for the filter designer to select between a set of different pre-configured parameters, which may have been designed for different audio systems, listening environments and/or for the purpose of introducing special characteristics into the resulting sound. In such a case, the preconfigured options are normally stored in the peripheral memory 40 and loaded into the system memory during execution of the filter design program.

The filter designer may also define a reference system by using the user interface 50. Instead of determining a system model based on microphone measurements, it is also possible for the filter designer to select a model of the audio system from a set of different preconfigured system models. Preferably, such a selection is based on the particular audio equipment with which the resulting precompensation filter is to be used. Another option is to design a set of filters for a selected appropriate set of weighting matrices to be able to vary the degree of support provided by the selected set of support loudspeakers.

Preferably, the audio filter is embodied together with the sound generating system so as to enable reproduction of sound influenced by the filter.

In an alternative implementation, the filter design is performed more or less autonomously with no or only marginal user participation. An example of such a construction will now be described. The exemplary system comprises a supervisory program, system identification software and filter design software. Preferably, the supervisory program first generates test signals and measures the resulting acoustic response of the audio system. Based on the test signals and the obtained measurements, the system identification software determines a model of the audio system. The supervisory program then gathers and/or generates the required design parameters and forwards these design parameters to the filter design program, which calculates the audio precompensation filter parameters. The supervisory program may then, as an option, evaluate the performance of the resulting design on the measured signal and, if necessary, order the filter design program to determine a new set of filter parameters based on a modified set of design parameters. This procedure may be repeated until a satisfactory result is obtained. Then, the final set of filter parameters are downloaded/implemented into the audio precompensation controller.

It is also possible to adjust the filter parameters of the precompensation filter adaptively, instead of using a fixed set of filter parameters. During the use of the filter in an audio system, the audio conditions may change. For example, the position of the loudspeakers and/or objects such as furniture in the listening environment may change, which in turn may affect the room acoustics, and/or some equipment in the audio system may be exchanged by some other equipment leading to different characteristics of the overall audio system. In such a case, continuous or intermittent measurements of the sound from the audio system in one or several positions in the listening environment may be performed by one or more microphone units, optionally wirelessly connected, or similar sound recording equipment. The recorded sound data may then be fed, optionally wirelessly, into a filter design system, which calculates a new audio system model and adjusts the filter parameters so that they are better adapted for the new audio conditions.

Naturally, the invention is not limited to the arrangement of FIG. 4. As an alternative, the design of the precompensation filter and the actual implementation of the filter may both be performed in one and the same computer system 100 or 200. This generally means that the filter design program and the filtering program are implemented and executed on the same DSP or microprocessor system.

The audio precompensation controller may be realized as a standalone equipment in a digital signal processor or computer that has an analog or digital interface to the subsequent amplifiers, as mentioned above. Alternatively, it may be integrated into the construction of a digital preamplifier, a car audio system, a cinema theater audio system, a concert hall audio system, a computer sound card, a compact stereo system, a home audio system, a computer game console, a TV, a docking station for an MP3 player, a sound bar or any other device or system aimed at producing sound. It is also possible to realize the precompensation filter in a more hardware-oriented manner, with customized computational hardware structures, such as FPGAs or ASICs.

In a particular example, the audio precompensation controller is implemented as a linear stable causal feedforward controller.

It should be understood that the precompensation may be performed separate from the distribution of the sound signal to the actual place of reproduction. The precompensation signal generated by the precompensation filter does not necessarily have to be distributed immediately to and in direct connection with the sound generating system, but may be recorded on a separate medium for later distribution to the sound generating system. The compensation signal could then represent for example recorded music on a CD or DVD disk that has been adjusted to a particular audio equipment and listening environment. It can also be a precompensated audio file stored on an Internet server for allowing subsequent downloading or streaming of the file to a remote location over the Internet.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible.

REFERENCES

[1] B. D. O. Anderson and J. B. Moore. *Optimal Control, Linear Quadratic Methods*. Prentice-Hall, Englewood Cliffs, N.J., 1990.

[2] E. Bazil. *Sound Mixing Tips and Tricks*. PC Publishing, first edition, 2008.

[3] J. Borenius. On loudspeaker response in sound control rooms. *Journal of the Audio Engineering Society,* 29(4): 258-261, April 1981.

[4] L.-J. Brännmark. Robust audio precompensation with probabilistic modeling of transfer function variability. In *IEEE Workshop on Applications of Signal Processing to Audio and Acoustics, WASPAA'09, Proceedings*, pages 193-196, New Paltz, N.Y., October 2009.

[5] L.-J. Brännmark and A. Ahlén. Spatially robust audio compensation based on SIMO feedforward control. *IEEE Transactions on Signal Processing,* 57(5), May 2009.

[6] L.-J. Brännmark, A. Bahne, and A. Ahlén. Compenstion of loudspeaker-room responses using MIMO feedforward control. *IEEE Transactions on Audio, Speech, and Language Processing,* 21(6):1201-1216, 2013.

[7] J. Couling. Dolby digital surround systems. In *Audio Engineering Society Conference: UK 14th Conference: Audio—The Second Century,* 6 1999.

[8] N. H. Crowhurst. Basic requirements for a stereophonic system. *Journal of the Audio Engineering Society,* 5(3): 129-134, 1957.

[9] M. D. Davis. Equipment performance specifications in stereo television production and transmission. In *Audio Engineering Society Conference: 4th International Conference: Stereo Audio Technology for Television and Video,* 5 1986.

[10] EBU. Listening conditions for the assessment of sound programme material: monophonic and two-channel stereophonic. Technical Report EBU Tech. 3276—2nd edition, European Broadcasting Union, May 1998.

[11] Dolby Laboratories Inc. Dolby surround mixing manual issue 2. Technical document, Part No. 91536, 2005.

[12] T. Kailath. *Linear Systems*. Prentice-Hall, Englewood Cliffs, N.J., 1980.

[13] V. Kučera. *Analysis and Design of Discrete Linear Control Systems*. Academia, Prague, 1991.

[14] H. Kwakernaak and R. Sivan. *Linear Optimal Control Systems*. Wiley, New York, 1972.

[15] B. C. J. Moore. *An Introduction to the Psychology of Hearing*. Elsevier Academic Press, fifth edition, 2004.

[16] K. Öhrn. *Design of Multivariable Cautious Discrete-Time Wiener Filters: A Probabilistic Approach*. PhD thesis, Uppsala University, Sweden, 1996.

[17] K. Öhrn, A. Ahlén, and M. Sternad. A probabilistic approach to multivariable robust filtering and open-loop control. *IEEE Transactions on Automatic Control,* 40(3): 405-418, March 1995.

[18] M. Sternad and A. Ahlén. LQ controller design and self-tuning control. In K. Hunt, editor, *Polynomial Methods in Optimal Control and Filtering*, pages 56-92. Peter Peregrinus, London, UK, 1993.

[19] M. Sternad and A. Ahlén. Robust filtering and feedforward control based on probabilistic descriptions of model errors. *Automatica,* 29(3):661-679, 1993.

[20] G. Theile. On the naturalness of two-channel stereo sound. *Journal of the Audio Engineering Society,* 39(10): 761-767, 1991.

[21] F. E. Toole. *Sound Reproduction*, chapter 15. Focal Press, 2008.

The invention claimed is:

1. A method for determining an audio precompensation controller for an associated sound generating system comprising a total of N≥2 loudspeakers, each of said loudspeakers having a loudspeaker input, said audio precompensation controller having a number L≥2 inputs for L input signals and N outputs for N controller output signals, one to each loudspeaker of said sound generating system, said audio precompensation controller having a number of adjustable filter parameters, said method comprising the steps of:

estimating, for each one of at least a subset of said N loudspeaker inputs, an impulse response at each of a plurality M≥2 of measurement positions, distributed in a region of interest in a listening environment, based on sound measurements at said M measurement positions;

specifying, for each one of said L input signals, a selected one of said N loudspeakers as a primary loudspeaker;

specifying, for each of the L input signals, a loudspeaker pair, if feasible, where said loudspeaker pair is required to be symmetric, or similar, with respect to the listening position;

specifying, for each primary loudspeaker, a target impulse response at each of said M measurement positions; and determining, for each one of said L input signals, based on the selected primary loudspeaker and the selected loudspeaker pair, filter parameters of said audio precompensation controller so that a criterion function is optimized under the constraint of stability of the dynamics of said audio precompensation controller, with said criterion function including a weighted summation of powers of differences between the compensated estimated impulse responses and the target impulse responses over said M, or a subset of said M, measurement positions, and a weighted and permuted summation of powers of differences between at least one pair of equalized symmetrical room transfer functions.

2. The method of claim 1, wherein, for at least one of said L input signals and the corresponding selected primary loudspeaker, a selected subset S including one or more of said N loudspeakers is specified as support loudspeakers, where said primary loudspeaker is not part of said subset.

3. The method of claim 1 wherein said method comprises the step of merging said filter parameters, determined for said L controller input signals, into a merged set of filter parameters for said audio precompensation controller.

4. The method of claim 1, wherein said audio precompensation controller, taking pairwise channel similarity into account, is configured for controlling the acoustic response of P primary loudspeakers, where 2≤P≤L and 2≤P≤N, by the combined use of said P primary loudspeakers.

5. The method of claim 1 wherein said target impulse response has an acoustic propagation delay, where said acoustic propagation delay is determined based on the distance from the primary loudspeaker to the respective measurement position.

6. The method of claim 1, wherein said step of determining filter parameters of said audio precompensation controller is based on a Linear Quadratic Gaussian (LQG) optimization of the parameters of a stable, linear and causal multivariable feedforward controller based on a given target dynamical system, a similarity condition, and a dynamical model of the sound generating system.

7. The method of claim 1, wherein each one of said N controller output signals of said audio precompensation controller is fed to a respective loudspeaker via an all-pass filter including a phase compensation component and a delay component, yielding N filtered controller output signals.

8. The method of claim 1, wherein said criterion function includes penalty terms, with said penalty terms being such that similarity between the channels of the selected loudspeaker pair(s) is taken into account in all or a subset of said M measurement positions and such that the importance of different measurement positions, in which similarity is taken into account, may be weighted with respect to both frequency and space.

9. The method of claim 8, wherein for at least one of said L input signals and the corresponding selected primary loudspeaker, a selected subset S including one or more of said N loudspeakers is specified as support loudspeakers, where said primary loudspeaker is not part of said subset, said penalty terms are differently chosen a number of times and said step of determining filter parameters of said audio precompensation controller is repeated for each choice of said penalty terms, resulting in a number of instances of said audio precompensation controller, each of which produces signal levels with individually constrained magnitudes to said support loudspeakers for specified frequency bands.

10. The method of claim 1, wherein said criterion function includes, firstly, a set of models describing a range of possible errors in the estimated impulse responses, and secondly, an aggregation operation, where said aggregation operation is a sum, a weighted sum or a statistical expectation over said set of models.

11. The method of claim 1, wherein said step of determining filter parameters of said audio precompensation controller is also based on adjusting filter parameters of said audio precompensation controller to reach a target magnitude frequency response, taking into account similarity, of said sound generating system including said audio precompensation controller, in at least a subset of said M measurement positions.

12. The method of claim 11 wherein said step of adjusting filter parameters of said audio precompensation controller is based on the evaluation of magnitude frequency responses in at least a subset of said M measurement positions and thereafter determining a minimum phase model of said sound generating system including said audio precompensation controller.

13. The method of claim 1, where the target impulse responses are non-zero and include adjustable parameters that can be modified within prescribed limits, and where the adjustable parameters of the target impulse responses, as well as the adjustable parameters of the audio precompensation controller, are adjusted jointly, with the aim of optimizing said criterion function.

14. The method of claim 1 wherein said audio precompensation controller is created by implementing said filter parameters in an audio filter structure.

15. The method of claim 14 wherein said audio filter structure is embodied together with said sound generating system to enable generation of said target impulse response at said M measurement positions in said listening environment.

16. The method of claim 1, wherein said audio precompensation controller, taking pairwise channel similarity into account, is configured for controlling the acoustic response of P primary loudspeakers, where $2 \leq P \leq L$ and $2 \leq P \leq N$, by the combined use of said P primary loudspeakers and, for each primary loudspeaker, also an additional number of support loudspeakers $0 \leq S \leq N-1$ of said N loudspeakers.

17. An audio precompensation controller determined by using the method of claim 1.

18. An audio system comprising a sound generating system and an audio precompensation controller in the input path to said sound generating system, wherein said audio precompensation controller is determined by using the method of claim 1.

19. A system for determining an audio precompensation controller for an associated sound generating system comprising a total of $N \geq 2$ loudspeakers, each of said loudspeakers having a loudspeaker input, said audio precompensation controller having a number $L \geq 2$ inputs for L input signals and N outputs for N controller output signals, one to each loudspeaker of said sound generating system, said audio precompensation controller having a number of adjustable filter parameters, wherein said system comprises:

means for estimating, for each one of at least a subset of said N loudspeaker inputs, an impulse response at each of a plurality $M \geq 2$ of measurement positions, distributed in a region of interest in a listening environment, based on sound measurements at said M measurement positions;

means for specifying, for each one of said L input signals, a selected one of said N loudspeakers as a primary loudspeaker;

means for specifying, for each of the L input signals, a loudspeaker pair, if feasible, where said loudspeaker pair is required to be symmetric, or similar, with respect to the listening position;

means for specifying, for each primary loudspeaker, a target impulse response at each of said M measurement positions; and means for determining, for each one of said L input signals, based on the selected primary loudspeaker and the selected loudspeaker pair, filter parameters of said audio precompensation controller so that a criterion function is optimized under the constraint of stability of the dynamics of said audio precompensation controller, with said criterion function including a weighted summation of powers of differences between the compensated estimated impulse responses and the target impulse responses over said M, or a subset of said M, measurement positions, and a weighted and permuted summation of powers of differences between at least one pair of equalized symmetrical room transfer functions.

20. The system of claim 19 wherein, for at least one of said L input signals and the corresponding selected primary loudspeaker, a selected subset S including one or more of said N loudspeakers is specified as support loudspeakers, where said primary loudspeaker is not part of said subset, and wherein said system comprises means for merging said filter parameters, determined for said L controller input signals, into a merged set of filter parameters for said audio precompensation controller.

21. The system of claim 19 wherein said means for determining filter parameters of said audio precompensation controller is configured to operate based on a Linear Quadratic Gaussian (LQG) optimization of the parameters of a stable, linear and causal multivariable feedforward controller based on a given target dynamical system, a similarity condition, and a dynamical model of the sound generating system.

22. A computer program product encoded on a non-transitory computer-readable recording medium that, upon execution by a processor device of a computer system, causes the computer system to operate as an audio precompensation controller for an associated sound generating system including a total of $N \geq 2$ loudspeakers, each of said loudspeakers having a loudspeaker input, said audio precompensation controller having a number L inputs for L input signal(s) and N outputs for N controller output signals, one to each loudspeaker of said sound generating system, said audio precompensation controller having a number of adjustable filter parameters, wherein said computer program configured to cause the computer system to perform the functions of:

estimating, for each one of at least a subset of said N loudspeaker inputs, an impulse response at measurement position(s) in a listening environment, based on sound measurements at said measurement positions;

specifying at least one loudspeaker pair, where said loudspeaker pair is required to be symmetric, or similar, with respect to the listener position; and determining, for each one of said L input signals, based on the selected loudspeaker pair, filter parameters of said audio precompensation controller so that a criterion function is optimized under the constraint of stability of the dynamics of said audio precompensation controller, with said criterion function including a weighted and permuted summation of powers of differences between at least one pair of equalized symmetrical room transfer functions.

* * * * *